US006738023B2

(12) United States Patent
Scott et al.

(10) Patent No.: US 6,738,023 B2
(45) Date of Patent: May 18, 2004

(54) MULTIBAND ANTENNA HAVING REVERSE-FED PIFA

(75) Inventors: James Yale Scott, Laurel, MD (US); Gregory S. Mendolia, Ellicott City, MD (US)

(73) Assignee: Etenna Corporation, Laurel, MD (US)

( * ) Notice: Subject to any disclaimer, the term of this patent is extended or adjusted under 35 U.S.C. 154(b) by 0 days.

(21) Appl. No.: 10/272,435

(22) Filed: Oct. 16, 2002

(65) Prior Publication Data

US 2004/0075608 A1 Apr. 22, 2004

(51) Int. Cl.[7] ..... H01Q 1/38
(52) U.S. Cl. ..... 343/700 MS; 343/702
(58) Field of Search ..... 343/700 MS, 702, 343/745, 846, 848

(56) References Cited

U.S. PATENT DOCUMENTS 6,404,395 B1 * 6/2002 Masuda ..... 343/702
6,448,932 B1 * 9/2002 Stoiljkovic et al. .. 343/700 MS
6,476,769 B1 * 11/2002 Lehtola ..... 343/702
6,535,167 B2 * 3/2003 Masuda et al. ..... 343/700 MS
6,538,604 B1 * 3/2003 Isohatala et al. ..... 343/700 MS
6,618,011 B2 * 9/2003 Eggleston et al. ... 343/700 MS
2003/0025637 A1 * 2/2003 Mendolia et al. ..... 343/702

* cited by examiner

*Primary Examiner*—Tan Ho
(74) *Attorney, Agent, or Firm*—Brinks Hofer Gilson & Lione

(57) ABSTRACT

A multiband antenna includes a 5–6 GHz PIFA surrounded on two or three sides by a 2.4 GHz RFPIFA. The PIFA and RFPIFA are tunable by removing fingers from the PIFA and either removing portions of or creating at least one area in the RFPIFA where inductance may be added. The RFPIFA contains an inductive meanderline. An out-of-plane matching stub is provided between the feed and the ground plane to impedance match the antenna. The PIFA/RFPIFA is supported by a plastic mesa tabletop whose legs are mounted directly to the ground plane of a PCB at the corner of the PCB. Electronic components on the PCB can be mounted underneath the multiband antenna.

65 Claims, 18 Drawing Sheets

200

MULTIBAND ANTENNA HAVING REVERSE-FED PIFA

BACKGROUND

Mobile communication devices, such as cellular telephones, PDAs, handsets, and laptop computers, require antennas for wireless communication and previously used multiple antennas for operation at various frequency bands. Recent wireless devices, however, use a single antenna to operate in multiple frequency bands. One such frequency range increasing in popularity is the ISM band (2.4 GHz), which covers frequencies between 2.4–2.4835 GHz in the United States with some variations in other countries. Different protocols are used to transmit and receive signals in this band: the Bluetooth Standard published by the Bluetooth Special Interest Group and the IEEE Standard 802.11b published by the Institute of Electrical and Electronic Engineers. The UNII (Unlicensed National Information Infrastructure) band covering the 5–6 GHz range is another frequency band that has been recently allocated (specifically, a 200 MHz block at 5.15 MHz to 5.35 MHz and a 100 MHz block at 5.725 MHz to 5.825 MHz) to alleviate some of the problems that plague the 2.4 GHz band, e.g. saturation from wireless phones, microwave ovens, and other emerging technologies. The UNII band uses IEEE Standard 802.11a, which supports data rates of up to 54 Mbps and is faster than the 802.11b standard, which supports data rates of up to 11 Mbps. In addition, unlike the 802.11b standard, the 802.11a standard departs from spread-spectrum technology, instead using a frequency division multiplexing scheme that's intended to be friendlier to office environments. Of course, there are many other frequency bands over which wireless devices may operate, including the 800 MHz, GSM and PCS, GSM and DCS, or GPS L1 and L2 bands.

As one example of conventional antennas that operate in multiple frequency bands, including the 2.4 GHz range, SkyCross has triband antennas (antennas operating in three frequency ranges) that range in size from 20×18×3 mm to 22.3×14.9×6.2 mm. The smallest antenna has an efficiency of better than 60% but a poor Voltage Standing Wave Ratio (VSWR) of less than 3:1 (the larger antenna has an improved VSWR of 2:1 but an unreported efficiency). Other manufacturers include Ethertronics, having an antenna only matched to −6 dB across the upper band (with a peak efficiency of 75% based on the shown return loss plot), and Tyco Electronics, having a circular antenna of 16 mm diameter and 6 mm height with a better than 2.5:1 VSWR but again, unreported efficiency.

Ample room remains for improvement in multiple areas of interest for these antennas for the designer, manufacturer and ultimately consumer with the ever-increasing demand for smaller and lighter (as well as cheaper) consumer electronics. These areas include not only the efficiency and overall performance, but also the cost, size and weight of the antenna. Of course, other conventional antennas used in other mobile communication devices face similar problems; the antenna performance is inherently linked to the size of the antenna as there is a fundamental limit on the efficiency and bandwidth that can be achieved based on the total volume of the antenna. In consequence, manufacturers of consumer electronics, who have little room in their products for antennas given the size and cost pressures, have conflicting interests to improve the device performance.

In addition to the size/performance tradeoff noted above, other problems occur when attempting to design antennas using frequency bands that are separated by large amounts, for example an octave or more apart. One such problem is the limiting of the higher frequency bandwidth due to reactive loading by the lower resonance. Adding to this, the antennas must be designed for low cost manufacturing as well as contain low cost materials to be cost effective for use in consumer electronic devices. This has led to the incorporation of the antenna within the package or case for reasons of durability and size.

Such wireless devices typically pack a substantial amount of circuitry in a very small package. The circuitry may include a logic circuit board and a radio frequency (RF) circuit board. The printed circuit board (PCB) can be considered an RF ground to the antenna, which is ideally contained in the case with the circuitry. A preferred antenna for use in these wireless devices would be one that can be placed extremely close to such a ground plane and still operate efficiently without adverse effects such as frequency detuning, reduced bandwidth, or compromised efficiency.

Various antennas have been developed to provide capability in at least one of the 2.4 and 5–6 GHz ranges. These include Planar Inverted-F Antennas (PIFAs), types of shorted patches, and various derivatives, which may contain meander lines. However, the need to integrate a single, compact, antenna structure that responds (i.e. has resonant frequencies) in both the 2.4 and 5–6 GHz ranges remains. Thus, to date, none of the above antennas satisfy present design goals, in which efficient, compact, low profile, light weight and cost effective antennas are desired.

BRIEF SUMMARY

To achieve the above objectives, in addition to other objectives mentioned herein, combination PIFA/reverse-fed planar inverted F-antennas (RFPIFA) having frequency response in multiple frequency ranges are disclosed in various embodiments below.

In one embodiment, the multiband antenna comprises a PIFA having a first resonant frequency and a RFPIFA surrounding the PIFA on two sides and having a second resonant frequency lower than the first resonant frequency. In another embodiment, the multiband antenna the RFPIFA surrounds the PIFA on three sides.

In a third embodiment, the PIFA and RFPIFA have first and second resonant frequencies, respectively, (with the RFPIFA resonant frequency lower than the PIFA resonant frequency) as well as being integrally formed from a single piece of conductive material and attached at one end such that dimensions of the multiband antenna are defined substantially by the RFPIFA.

Any of the embodiments may contain the elements below.

The multiband antenna may comprise an out-of-plane matching stub to impedance match the multiband antenna with external elements. This stub may extend from the feed line. The length and width of the stub as well as distance between the stub and the ground plane (i.e. the height of the stub) is chosen to optimize the impedance match. Similarly, an antenna element that has a third resonant frequency higher than the first resonant frequency may be disposed perpendicular to the ground plane.

The conductive material that forms the PIFA and RFPIFA may be separated from a ground plane by two layers having an effective permittivity of about 1 to about 1.7. The PIFA/RFPIFA may be disposed on an undercarriage, which is in turn supported by legs. The thickness of the undercarriage is about 0.3 to 1.0 mm and the overall thickness of the antenna is about 2 mm to 4 mm. The legs contact the ground plane such that the undercarriage is mounted on a printed circuit board (PCB) and the PIFA and RFPIFA are mounted over components mounted on the PCB. The legs may be plastic with metalized contacts positioned on the PCB for solder reflow connection. The multiband antenna may be mounted at an edge of the PCB.

The resonant frequencies of the PIFA and RFPIFA may be adjustable by removal of a portion of the PIFA or RFPIFA or addition of inductance at discrete locations including formation of a narrow inductive transmission line in the RFPIFA or between the PIFA and RFPIFA.

The multiband antenna may be devoid of dielectric loading and meander lines or may have one or more meanderlines having the same shape. A narrow inductive transmission line may be disposed between the meanderlines.

The largest dimension of the RFPIFA is at most 1/10 of the second resonant frequency without dielectric loading. The resonant frequency of the PIFA may be 5 to 6 GHz while that of the RFPIFA about 2.4 GHz.

The multiband antenna may be relatively insensitive to proximity effects and to changes in ground plane size and component layout on a PCB on which the multiband antenna is mounted.

In a fourth embodiment, a method for multiband reception of an antenna comprises communicating in first and second resonant frequencies via a PIFA and RFPIFA, respectively, (with the RFPIFA resonant frequency lower than the PIFA resonant frequency) and limiting an area of the PIFA and RFPIFA such that dimensions of the antenna are defined substantially by the RFPIFA.

In a fifth embodiment, a method for multiband reception of an antenna comprises communicating in first and second resonant frequencies via a PIFA and RFPIFA, respectively, (with the RFPIFA resonant frequency lower than the PIFA resonant frequency) and adjusting one of the resonant frequencies by one of removing a portion of the PIFA or RFPIFA or addition of inductance at discrete locations including forming a narrow inductive transmission line in the RFPIFA or between the PIFA and RFPIFA.

DETAILED DESCRIPTION OF PREFERRED EMBODIMENTS

As described above, antenna performance must always be weighed against the size of the antenna. With any approach there will be a fundamental limit on the efficiency and bandwidth that can be achieved based on the total volume of the antenna. The multiband PIFA/RFPIFAs of the present embodiments are electrically very small for the efficiency bandwidth product they achieve.

The structure of the present antennas as well as the size and placement of the structure maximize the antenna efficiency and usable space in the consumer device while reducing the sensitivity of the antenna to proximity effects, such as those caused by nearby housing, and to changes in the size of the ground plane and component layout on a printed circuit board (PCB). In addition, the embodiments are relatively cheap to fabricate, having a simple integrated structure that may be stamped, easily modified to adjust the resonant frequencies of the PIFA and RFPIFA, and soldered to the PCB with conventional techniques. Use of injection molding during fabrication also increases repeatability in the thickness direction and reduces the antenna cost by using plastic as the undercarriage.

RFPIFA structures have been discussed at length, for example in U.S. provisional patent application serial No. 60/352,113 filed Jan. 23, 2002 and subsequently filed co-pending patent application Ser. No. 10/211,731 filed Aug. 2, 2002, both of which are entitled "Miniaturized Reverse-Fed Planar Inverted F Antenna," in the names of Greg S. Mendolia, John Dutton, and William E. McKinzie III, commonly assigned to the assignee of the present application, which are incorporated herein by reference in their entirety. Similarly, PIFA structures incorporating frequency selective surfaces (FSS) have be previously discussed in U.S. provisional application serial No. 60/310,655, filed Aug. 6,2001 and subsequently filed co-pending patent application Ser. No. 10/214,420 filed Aug. 6, 2002, entitled "Low Frequency Enhanced Frequency Selective Surface Technology and Applications" in the names of William E. McKinzie, III, Greg Mendolia, and Rodolfo E. Diaz which are incorporated herein by reference in their entirety and commonly assigned to the assignee of the present application.

The present embodiments incorporate a normally fed PIFA with a RFPIFA in as single integrated structure without the addition of off-chip components or connections thereof to achieve a compact, efficient, lightweight and cost effective antenna having resonances in multiple bands. In particular, the antennas described herein respond in both the 2.4 and 5–6 GHz frequency ranges. As an example of compactness, using comparable separate non-integrated PIFA and RFPIFAs rather than combining the PIFA/RFPIFA into a single structure, results in an approximately four fold volumetric increase as well as an increase in cost to achieve comparable efficiencies in the frequency range of interest.

Figure 1:
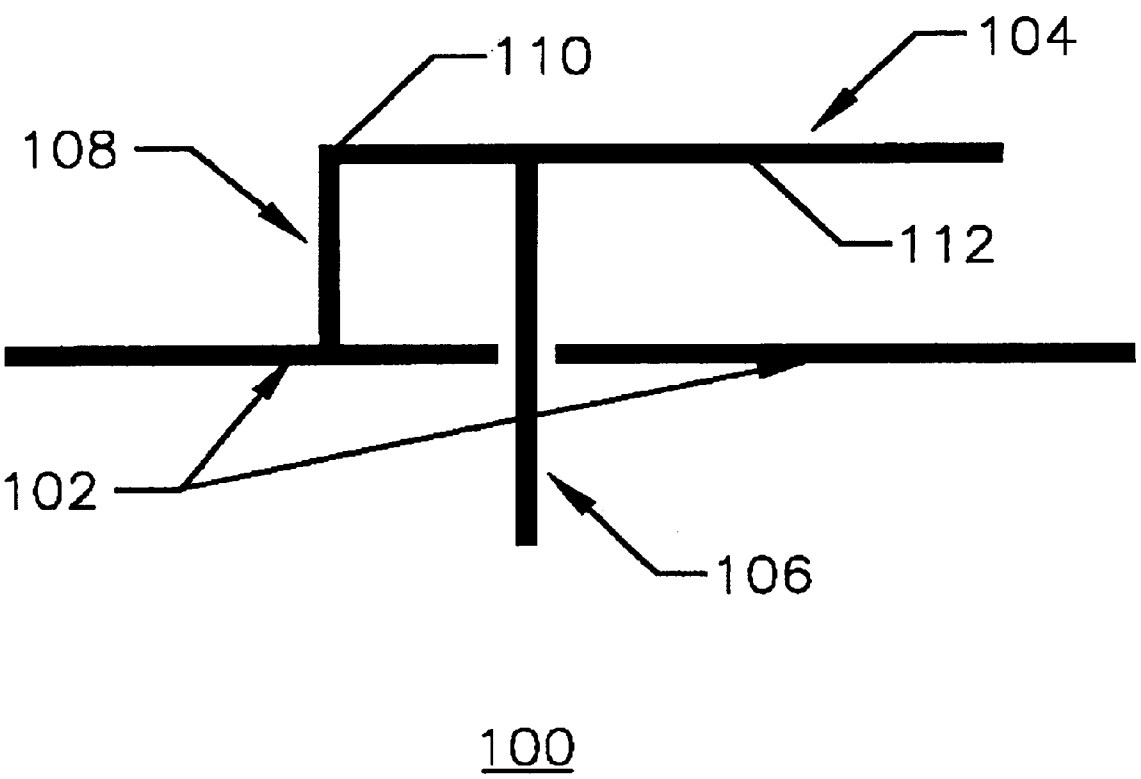
Fig 1 Prior Art
FIG. 1 shows a cross sectional view of a conventional PIFA.

By way of introduction only, in a conventional PIFA having the cross-sectional view shown in FIG. 1, the PIFA 100 includes a ground plane 102 and a radiating element 104. The PIFA 100 has a feed 106 positioned between a shorted end 110 and a radiating portion 112 of the radiating element 104. An RF short 108 electrically shorts the shorted end 110 of the radiating element 104 to the ground plane. The feed engages the radiating element at a feed point which is offset from the RF ground of the radiating element 104. The feed point is positioned between the RF ground, which engages the radiating element at the shorted end 110 of the radiating element 104, and the radiating portion 112 of the radiating element 104.

Figure 2:
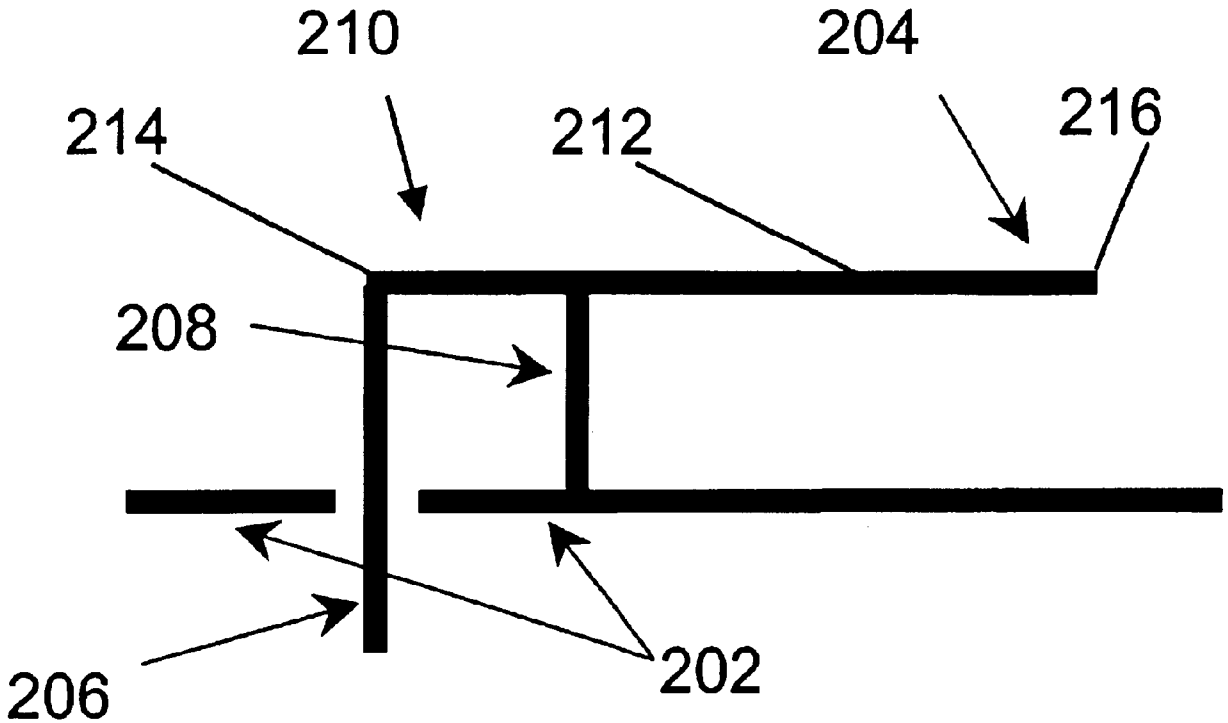
FIG. 2 shows a cross sectional view of a RFPIFA.

FIG. 2 shows a cross sectional view of a RFPIFA 200. The RFPIFA 200 includes a ground plane 202 and a radiating element 204 which is substantially parallel to the ground plane 202. The RFPIFA 200 further includes a feed 206 and an RF short 208. However, in the RFPIFA 200, the relative positions of the feed 206 and the RF short 208 have been exchanged in comparison to the conventional PIFA.

The radiating element 204 includes a feed point 214 at a feed end 210 and a radiating portion 212, terminating in an open end 216. The feed 206 engages the feed end 210, one end of the radiating element. In alternative embodiments, such as those shown in later figures, a stub may extend beyond the feed end 210 of the radiating element 204. The RF short 208 engages the radiating element 204 beyond the feed point 214. The effect is that the traditional feed point and ground point, as shown in FIG. 1, are reversed.

This arrangement is counter-intuitive, as the energy from the feed 206 now is presented with a short at the RF short 208 before the energy is transmitted to the main radiating portion 212 of the radiating element 204. Intuition suggests that the energy fed to the RFPIFA 200 would substantially pass to the ground plane 202 through the RF short 208. This, however, is not the case. The configuration of the RFPIFA 200 is fed from the end of the structure at feed end 210. There is no alternative path for the energy to flow other than across the RF short 208 in order to reach the radiating portion 212 of the radiating element 204. By configuring the feed 206 and the RF short 208 as shown in the drawing, the antenna 200 radiates very efficiently when placed close to the ground plane 202.

The frequency of operation of the RFPIFA 200 is defined by at least two dimensions. The first and greatest influence on frequency is the length 220 of the radiating element 204, from the feed 206 to the open end 216. The length of the radiating element 204 is approximately one-quarter of a free space wavelength. The second is the position of the RF short 208 with respect to the feed 206. The position of the RF short 208 or ground return is also used to optimize the impedance match and bandwidth of the antenna 200 as seen from the feed 206. Based on experiments, the distance between the feed and RF short along the radiating element is approximately 1/20 to 1/5 of the total length of the radiating element 204. The exact position of the RF short is determined to optimize bandwidth, impedance match, and efficiency.

The embodiments of the present set of multiband antennas illustrated below are triband antennas. The triband antennas are so called because they integrate a 5–6 GHz element (covering the 802.1 la frequency range of dual reception 5.15 MHz to 5.35 MHz and 5.725 MHz to 5.825 MHz) and a 2.4 GHz element into a single antenna with one RF port.

Figure 3:
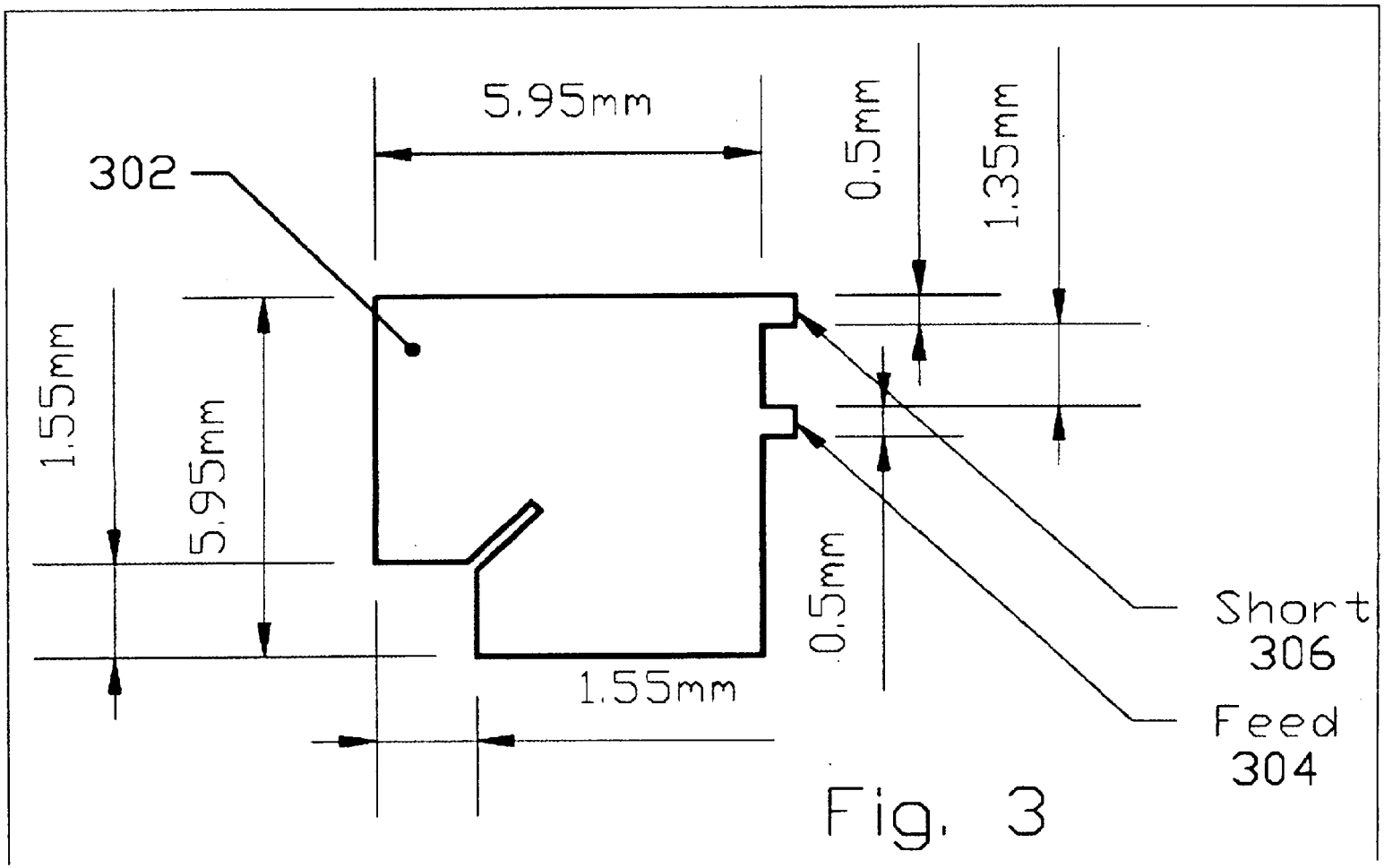
FIG. 3 shows a top view of a PIFA in an embodiment.

One embodiment of the 5–6 GHz element is shown below in FIG. 3. The 5–6 GHz element 300 is a planar PIFA 302 with nearly square dimensions. The PIFA 302 is formed from a metal or other conductive material. Any conductive material may be used which is not significantly lossy with respect to transmitting signals along the antenna. Specifically, in these embodiments, the PIFA 302 is fabricated as a single metallic patch. Although FIG. 3 shows a square cutout and diagonal notch in the patch, these sections do not have to be present as they merely alter the resonant frequency of the PIFA by changing the inductance and capacitance, as illustrated in later figures.

The feed 304 extends from an edge of the patch rather than the middle of the patch, as in the conventional PIFA of FIG. 1. As shown, the feed 304 is disposed at approximately the middle of the edge of the PIFA 302. The feed 304 is connected with a PCB (not shown). The short 306 is connected to a ground plane (not shown). The short 306 is disposed at approximately a corner of the PIFA 302 along the same edge as the feed 304. While any type of conductor, such as a pin or post, may be used as the feed 304 or short 306, the feed 304 and short 306 are microstrip lines and are integral with the radiating portion of the PIFA 302. Thus, the entire antenna 300 may be fabricated using simple, conventional techniques, such as a stamping process, to form the antenna.

Figure 4:
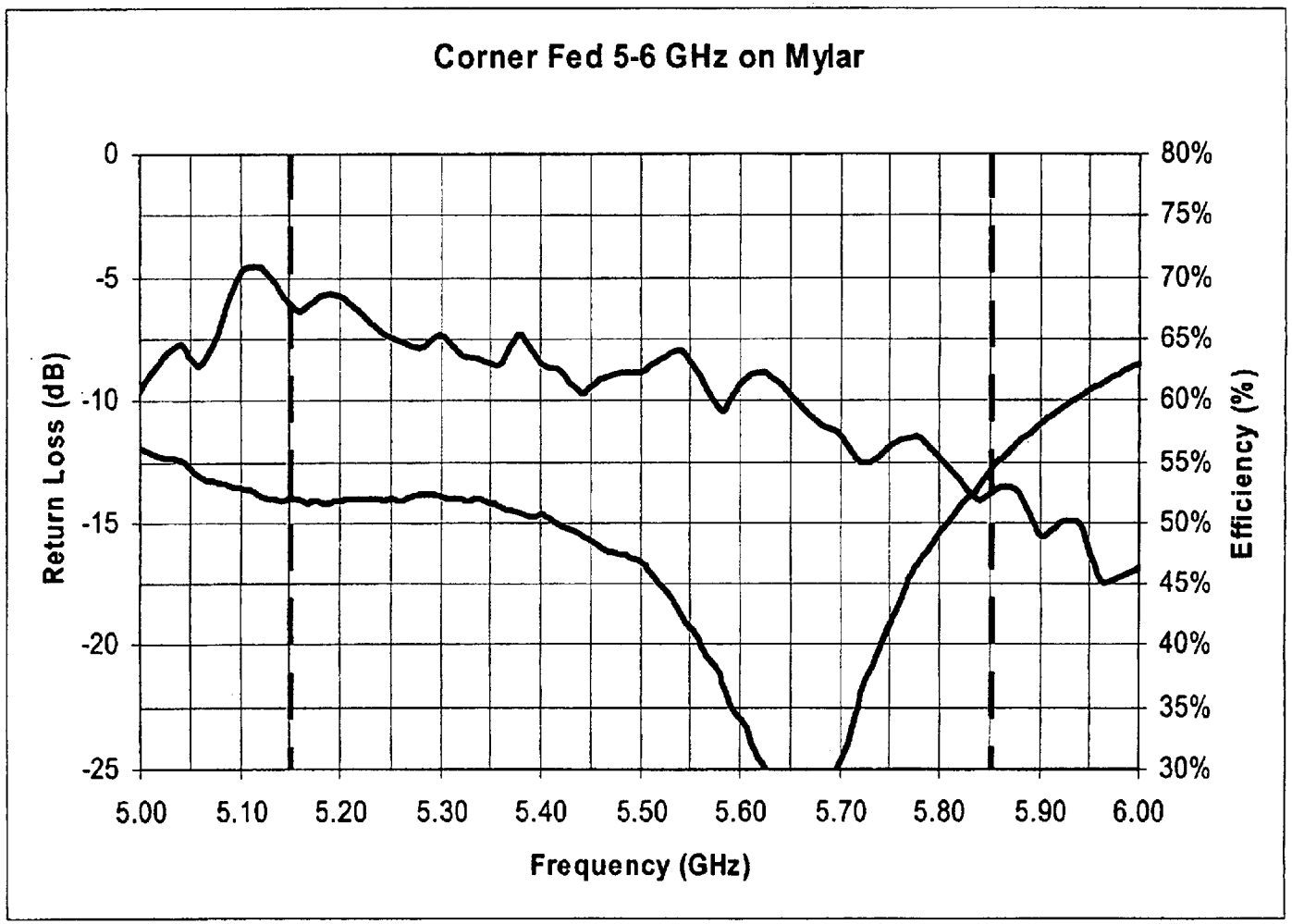
FIG. 4 illustrates the response of the PIFA.

The PIFA 302 has two radiating modes, one that corresponds to the length of the PIFA 302 and one that corresponds to its width. The resonant modes, i.e. resonant frequencies, are very close to each other in frequency. The PIFA 302 by itself has more than enough bandwidth to cover the 802.11a frequency range at a 10 dB return loss and better than 50% efficiency as shown by FIG. 4. The microstrip line that feeds this part has approximately 1–1.5 dB of insertion loss at 6 GHz making the return loss approximately 2 dB worse than what is shown and the efficiency approximately 1 dB better. The efficiency is thus better than 60% across the band with the return loss better than 10 dB across the band (and is actually better than 70% over a portion of the band). For the experimental results, the antenna was built on 0.005" polyimide with a 2.5 mm dielectric spacer made from Rohacell Foam ($\epsilon_r$). The same measurements performed on an antenna with air under the polyimide rather than a dielectric spacer indicate an efficiency of better than 70% across the band with the return loss better than 10 dB across the band.

Figure 5:
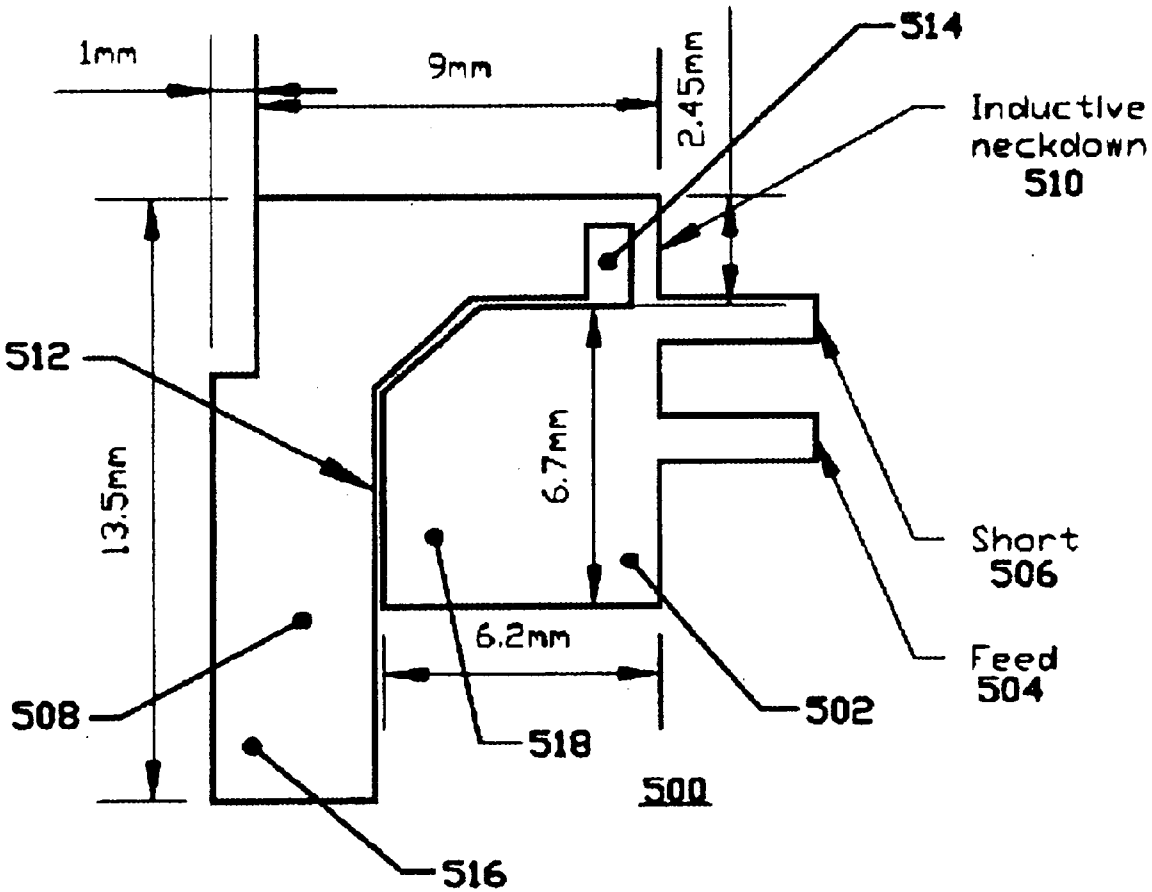
FIG. 5 shows a top view of an antenna of an embodiment.

FIG. 5 shows that a similar 5–6 GHz element (PIFA) 502 is combined with a 2.4 GHz element (RFPIFA) 508 to form the triband antenna 500. The PIFA 502, as above contains a feed 504 and short 506. The triangular cutout at the upper left corner in the figure is not essential. As above, the RFPIFA 508 employs a reverse feed in which the radiating portion 518 of the PIFA 502 forms a stub of the RFPIFA 510. This is to say that the feed 504 is more proximate to the radiating portion 518 of the PIFA 502 and more distal to the radiating portion 516 of the RFPIFA 508 than the short 506. The radiating portion 518 of the PIFA 502 and the radiating portion 516 of the RFPIFA 508 are formed on opposite ends of the antenna 500.

In this embodiment, the 2.4 GHz RFPIFA 508 is wrapped around the 5–6 GHz PIFA 502 such that the RFPIFA 508 surrounds the PIFA 502 on essentially two sides of the PIFA 502. The PIFA 502 and RFPIFA 508 are separated by a slot 512. There is some coupling across the slot 512 between the PIFA 502 and RFPIFA 508, but it has a minimal effect on the frequency of the two resonances. The width of the slot 512 is large enough so that the resonant frequencies of the PIFA 502 and RFPIFA 508 are minimally affected by small changes in the slot width due to coupling between the elements. This width is nominally 0.75 mm, but may be decreased to about 0.3 mm. The separation of the higher and lower frequency elements maintains the bandwidth at the upper frequency; that is the loss of bandwidth dramatically increases if the elements are separated. For example, conventional antennas show a 5 db return loss about 650 MHz apart, while in the present embodiments the 5 db return loss is about 1.5 GHz; thus the manner of combination of elements is important to the antenna performance, as discussed below. In this embodiment, the PIFA 502 and RFPIFA 508 are connected through a narrow inductive transmission line 510 formed by increasing the slot 512 to a notch 514 in the area between the two elements thereby decreasing the conductive area connecting the PIFA 502 and RFPIFA 508.

Figure 6:
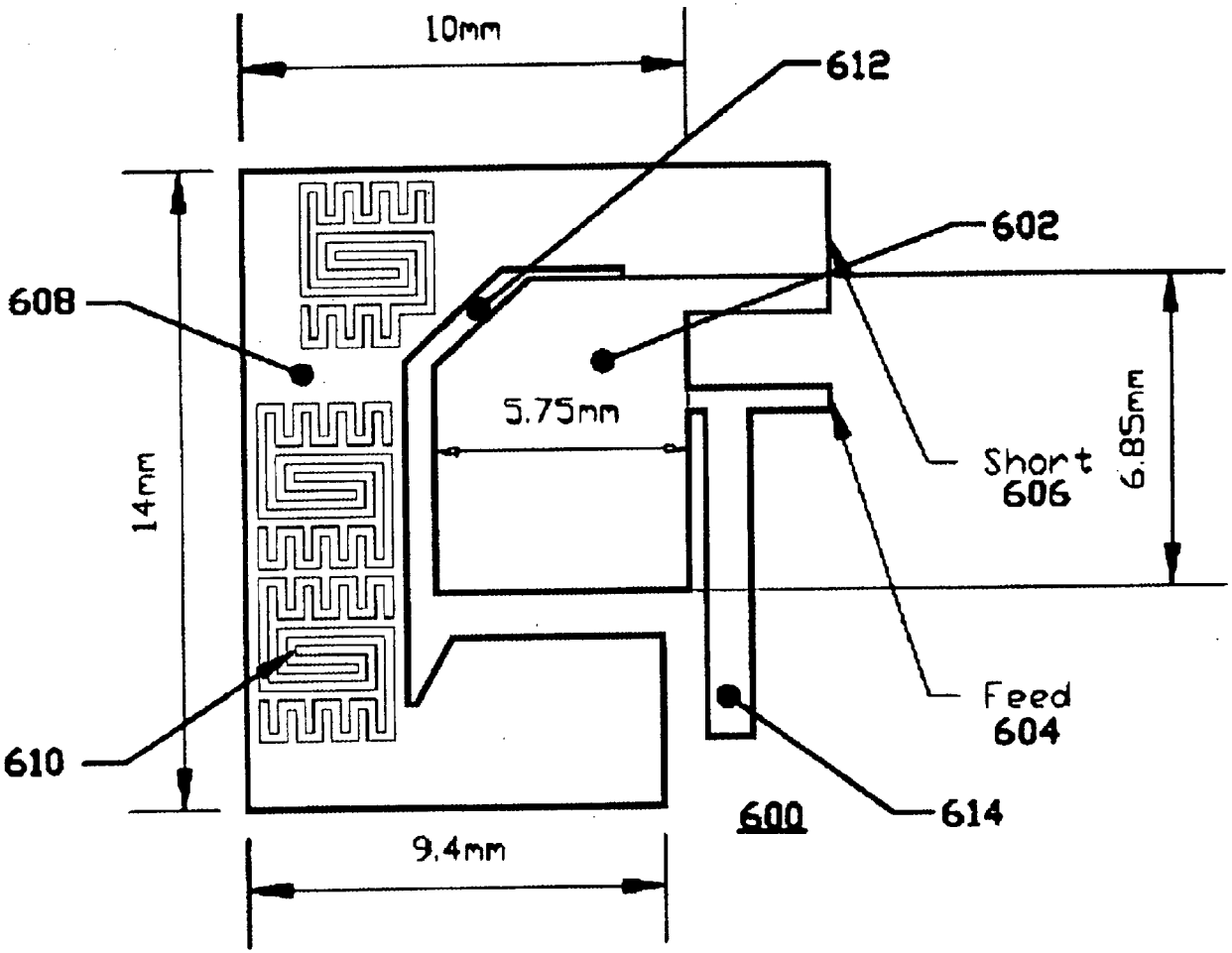
FIG. 6 shows a top view of an antenna of an embodiment.

FIG. 6 shows a second embodiment of the antenna. This multiband antenna 600, has the same basic features as the previous embodiment: PIFA 602, feed 604, short 606, RFPIFA 608 separated from the PIFA 602 by a slot 612 that comes down close to the short 606 but without a narrow inductive transmission line. In this case, however, the short 606 is much wider than that of the previous embodiment and the RFPIFA 608 substantially surrounds the PIFA 602 on three sides of the PIFA 602, rather than two sides (discounting the 0.6 mm extension of the PIFA 602 shown in the figure, which is about 10% of the total width). In addition, the RFPIFA 608 contains frequency selective surface (FSS) sections 610 and the antenna 600 features an out-of-plane matching stub 614. Further, unlike conventional antennas, the structure of the antenna 600 permits the ground plane disposed on the PCB underneath the antenna 600, and to which the short 606 is connected, to be located underneath either the entire antenna 600 or only a portion of the antenna 600 without appreciably affecting the characteristics of the antenna 600.

Use of the FSS 610 in the RFPIFA 608 permits a significant slow wave factor in the modes propagating on the equivalent FSS transmission line, resulting in a low resonant frequency. The size of the RFPIFA can be reduced such that the maximum dimension of the antenna is $\lambda/10$ (where $\lambda$ is the free space wavelength at the lowest resonant frequency). The weight of the structure is also relatively small because bulk dielectric loading is not needed to achieve this decrease in size. The use of an FSS in the RFPIFA additionally decreases the sensitivity of the resonant frequencies to changing environmental factors such as proximity to a human body.

The matching stub 614 is out-of-plane with the PIFA 602 and RFPIFA 608. The matching stub 614 matches the antenna 600 to 50Ω (or to whatever impedance is desired). The matching stub 614 is a stub that extends from the portion of the feed that is not in the same plane as the upper surface of the antenna 600, on which the PIFA 602 and RFPIFA 608 reside. The matching stub 614 thus extends along the side of the antenna 600 in a length direction of the antenna 600 essentially perpendicular to the upper surface of the antenna 600. The dimensions of the matching stub 614 as well as the distance between the matching stub 614 and ground plane (not shown) controls the effective impedance thereby permitting realization of a much greater range of impedances than can be compactly realized in the plane of the antenna as well as optimization of the impedance match. The length, width, and thickness of the matching stub 614 are dependant on the design characteristics. The matching stub 614 should be at least 1 mm off ground plane to prevent substantial variations in the impedance due to variations in the fabrication process (that might be present for instance if the matching stub were very close to the ground plane).

Because the matching stub 614 is out of plane with the other antenna elements, space is more effectively used by employing the previously unused out of plane area rather than increasing the lateral area in the same plane as the other antenna elements. In this regard, a compact line having substantially lower impedance may be realized using the out of plane matching stub compared to what could be realized by use of a matching stub in the plane of the antenna elements. Further, the use of the matching stub 614 means that additional matching components external to the antenna 600 are not required. In other embodiments that are not shown, another antenna structure having a higher resonance frequency may be disposed on out of plane with the PIFA and RFPIFA elements. Such an out of plane antenna may replace or may be used in addition to the matching stub 614.

Figure 7:
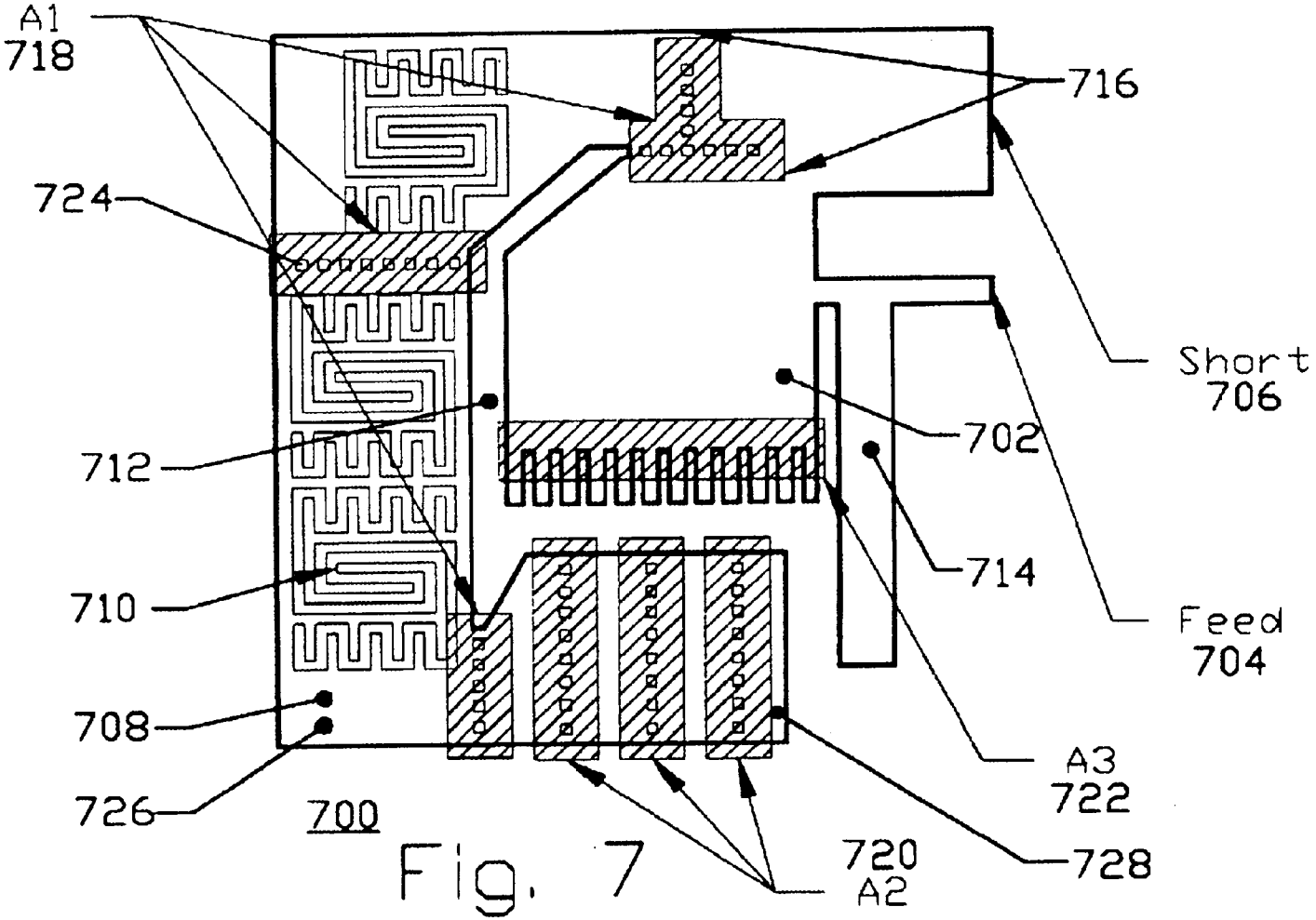
FIG. 7 shows a top view of an antenna of an embodiment.

In another embodiment shown in FIG. 7, the antenna 600 of the previous embodiment incorporates a mechanical tuning mechanism or means for tuning which permits tuning of the resonant frequencies of the antenna 700 of this embodiment in compensation for fabrication process variations, among other factors. This multiband antenna 700, has the same features as the embodiment shown in FIG. 6: PIFA 702, feed 704, short 706, RFPIFA 708 separated from the PIFA 702 by a slot 712 and containing FSS sections 710, and an out-of-plane matching stub 714, which have already been discussed.

The mechanical tuning mechanism contains multiple different individual mechanisms (718 or A1, 720 or A2, and 722 or A3) to alter the resonance frequency of the PIFA 702 and RFPIFA 708. Such mechanisms in the RFPIFA 708 include first and second sets of straps 718, 720. Each of the first and second set of straps 718, 720 is formed by a series of holes 724 in the metal of the RFPIFA 708. These holes 724 extend in a line substantially from one edge of the RFPIFA 708 at least halfway to the opposing edge. Material between holes in the first set of metal straps 718 is cut to form inductive neckdowns 716, i.e. narrow inductive transmission lines, that increase the inductance and decrease the frequency of the RFPIFA resonance.

The material between the holes 724 is cut such that the holes 724 in the first set of straps 718 are joined one by one as necessary to increase the inductance to the desired value. The first set of straps 718 and associated inductance of the narrow inductive transmission lines 716 is formed at various locations in the RFPIFA 708; between the FSS sections 710, between the RFPIFA 708 and the PIFA 702, and between the main body 726 and the end section 728 of the RFPIFA 708. In the embodiment above, the first two of these straps have holes that extend substantially from one edge of the RFPIFA 708 almost to the opposing edge, while the holes of the last of these straps extends about halfway to the opposing edge. The last of these straps may be used to control both the resonance frequency of the RFPIFA and the impedance matching between the RFPIFA and the PIFA. The first set of straps 718 may each be altered one at a time for greater control. By tuning the inductance at the three points shown in FIG. 7, the lower resonance can be shifted slowly down by a maximum of about 250 MHz.

The second set of straps 720, which increase the frequency coarsely, is slightly different from the first set of straps 718. The second set of straps 720 have holes that extend all the way across the end 728 of the RFPIFA 708, from the slot 712 to the opposing outer edge of the RFPIFA 708. To adjust the frequency of the RFPIFA 708 using the second set of straps 720, the strap closest to the end of the RFPIFA 708 (i.e. the end of the RFPIFA 708 most proximate to the matching stub 714) is completely cut through and the material removed such that the RFPIFA 708 is shortened. Tuning is effected by consecutively cutting through the second set of straps 720 one by one thereby consecutively removing the material closest to the end of the RFPIFA 708 and shorting the length of the RFPIFA 708. This coarse tuning increases the RFPIFA 708 frequency by up to a maximum of about 300 MHz. Using the first and second set of straps 718, 720, the frequency of the antenna 700 in the 2.4 GHz band may be adjusted down finely and up coarsely, respectively, over a range of about 550 MHz. The number and placement of both the first and second set of straps 718, 720 are variable depending on design considerations or convenience as well as the ultimate mechanical tolerance of the fabrication technique. For example, the conventional stamping process requires a minimum of 0.2 mm trace and a 0.2 mm gap between straps.

The resonance frequency upper 5–6 GHz band may be tuned by cutting or otherwise removing fingers 722 off of the edge of the PIFA 502. The twelve fingers 722 extend in parallel from the edge of the PIFA 702 most distal to the connection between the PIFA 702 and the RFPIFA 708 towards this connection. Each finger 722 that is removed shifts the upper resonance by about 30–40 MHz. If all the fingers 722 are removed, the total tuning range is about 500 MHz assuming the initial resonance is approximately 5 GHz. The number of fingers is alterable as desired within the minimum tolerance of the fabrication technique, as above, and with a larger number of fingers each providing a smaller change in frequency and a smaller of fingers each providing a larger change in frequency. Note that in any of the tuning mechanisms, the material can be easily cut or removed to alter the frequency because the material is exposed at the top of the overall antenna structure and has an undercarriage underneath the material that supports the material, as discussed below. Variations of the tuning mechanism may be found in a currently pending related U.S. application serial number entitled "Method of Mechanically Tuning Antennas for Low-Cost Volume Production," filed Oct. 16, 2002 in the names of Greg S. Mendolia and James Scott and commonly assigned to the assignee of the present application, incorporated herein by reference in its entirety.

Turning to the electrical characteristics of the RFPIFA, the reactance of the short will dominate the reactance of the open circuited line unless the open circuited line is at or near its resonant length. Assuming that the short can be represented by a small inductance to ground and that the 2.4 GHz element can be represented by an open ended transmission line 90 degrees long at 2.4 GHz, the reactance of the 2.4 GHz element with the short may be written as follows (where $Z_{tline}$ is the impedance of the transmission line, $L_{short}$ is the inductance associated with the short, ω is 2π*frequency, β is 2π*frequency/propagation velocity of the transmission line in meters per second, and 1 is the length of the transmission line):

$$Z_{2,4} = \frac{1}{((Z_{tline}/(-jZ_{tline}\cot(\beta l))) + (Z_{tline}/(jL_{short}\omega)))}$$

$$\Gamma_{2,4} = \frac{(Z_{2,4}-1)}{(Z_{2,4}+1)}$$

Figure 9:
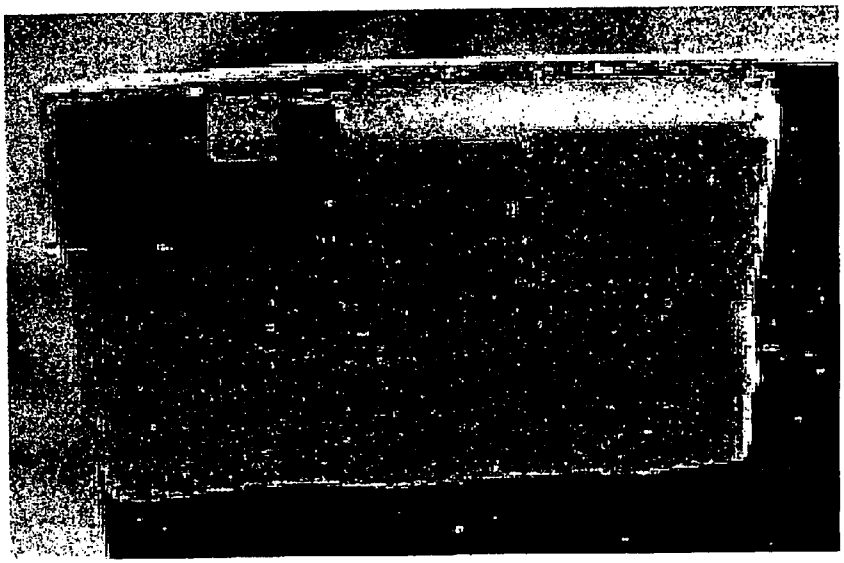
FIG. 9 shows a test setup for a short.
Figure 8:
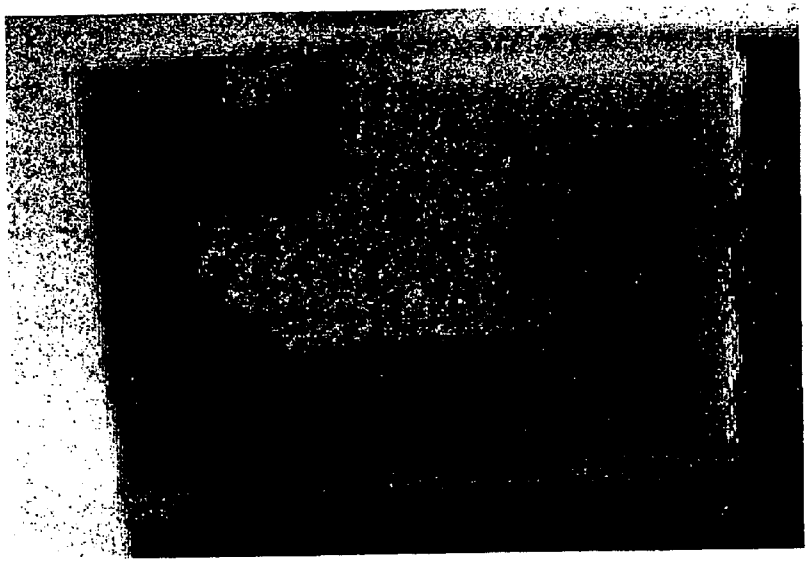
FIG. 8 shows a test setup for a RFPIFA.
Figure 10A:
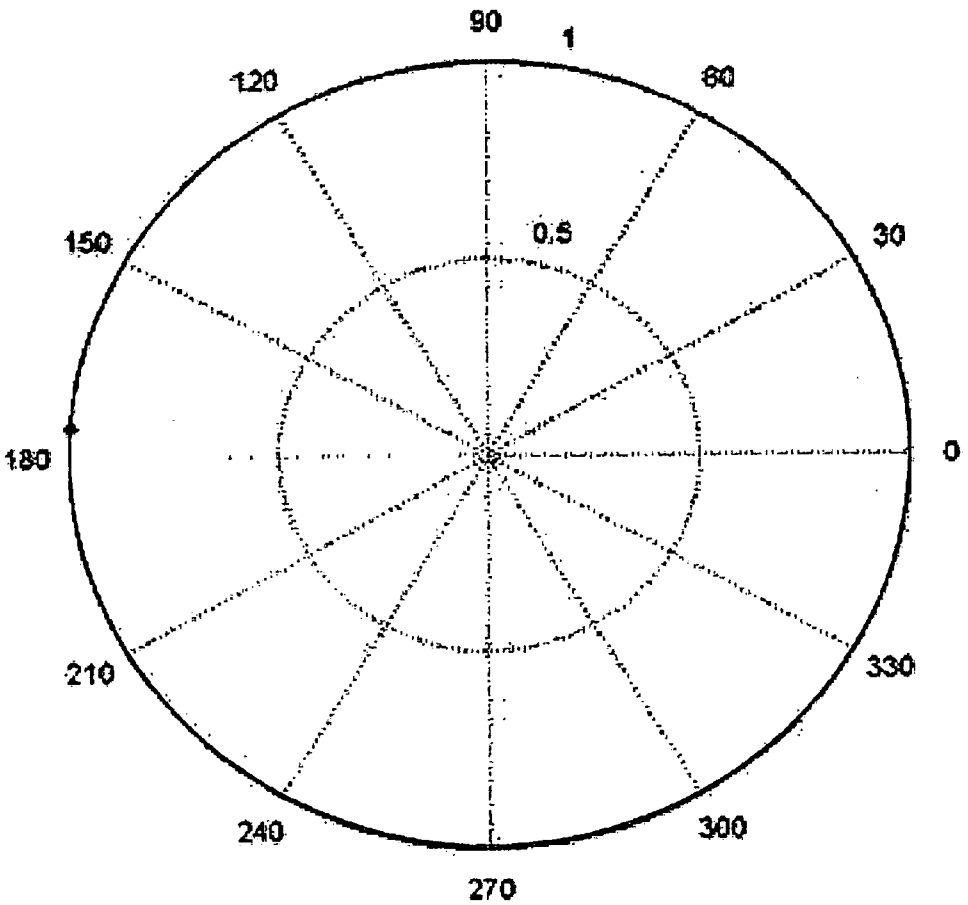
FIGS. 10*a–f* illustrate the electrical characteristics of the RFPIFA and short of FIGS. 8 and 9.
Figure 10B:
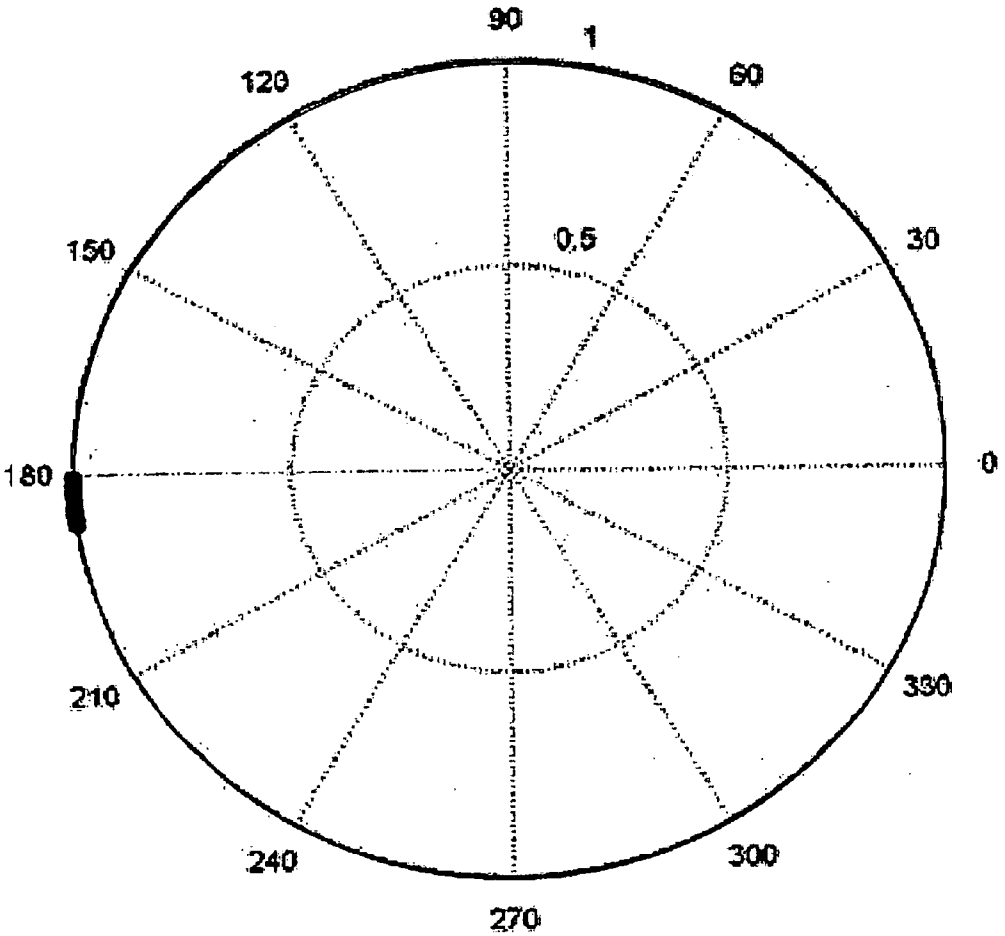
Figure 10C:
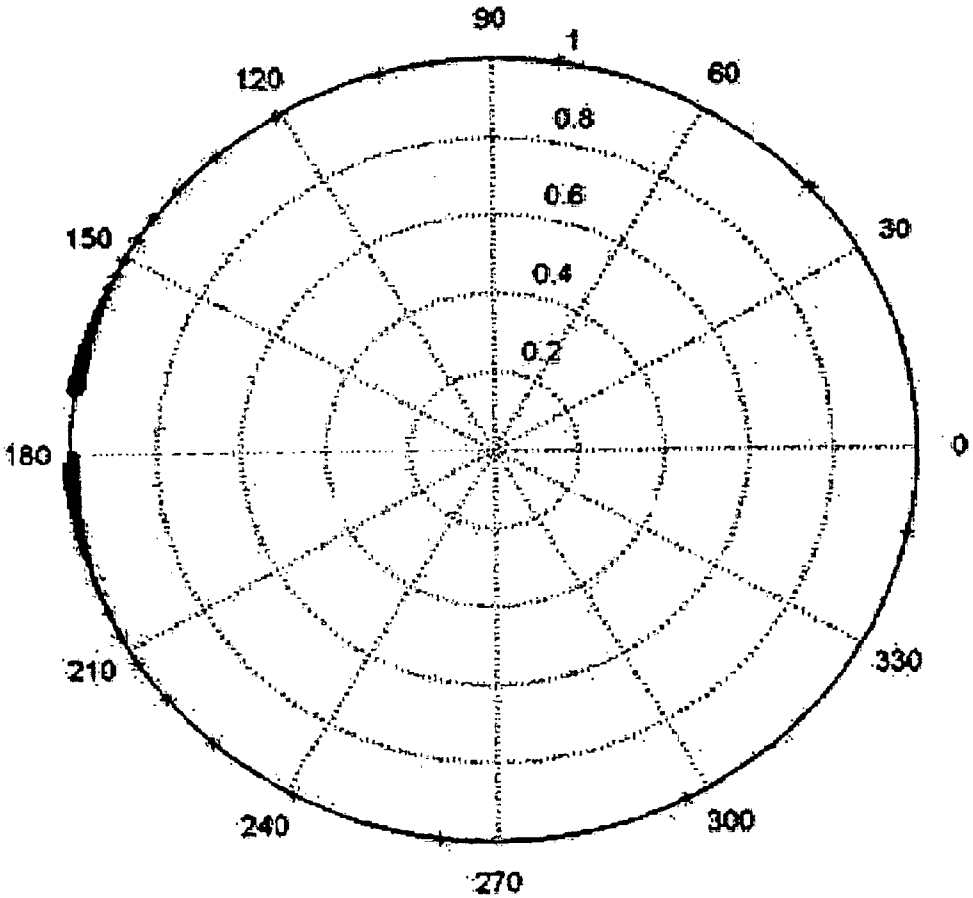
Figure 10D:
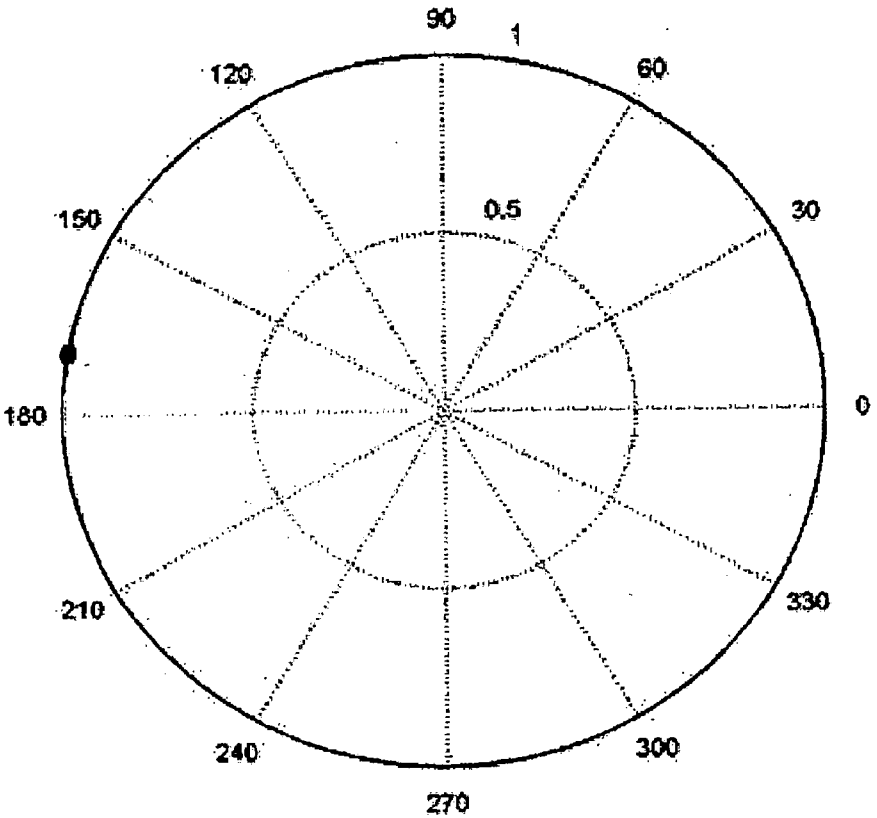
Figure 10E:
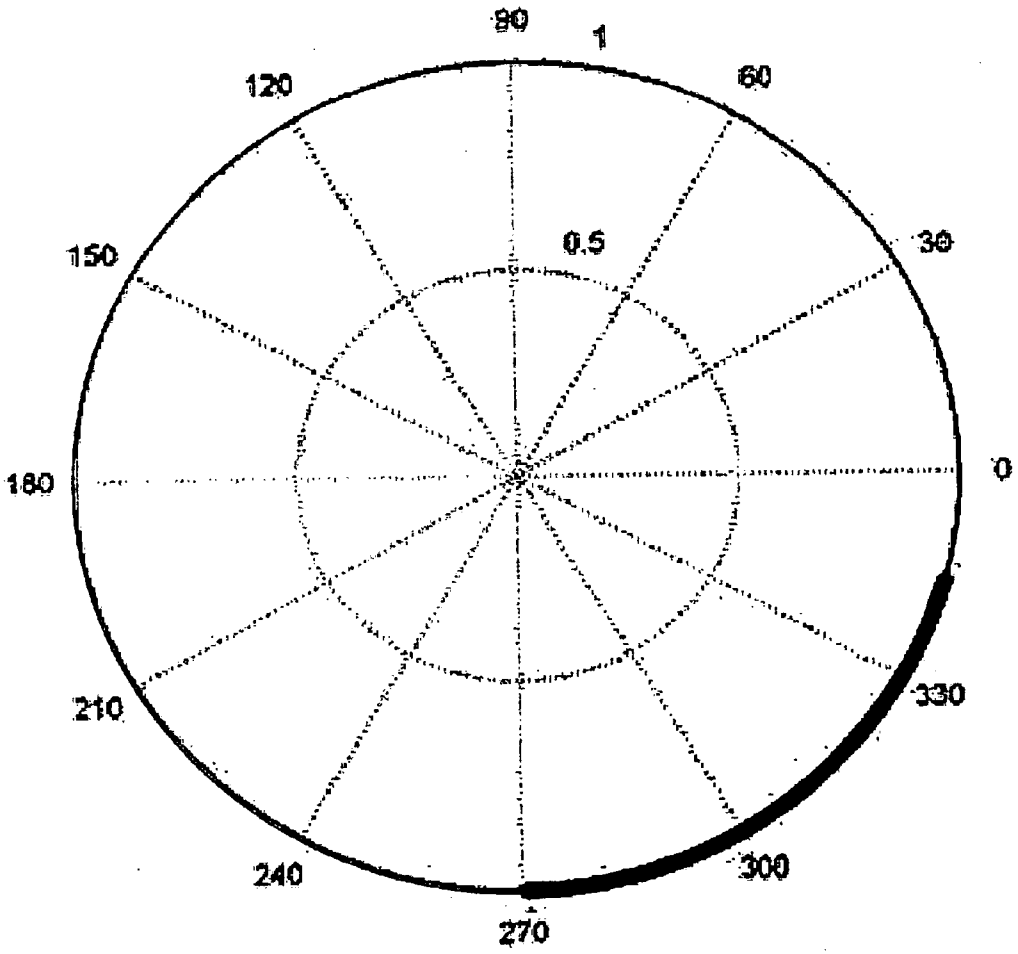
Figure 10F:
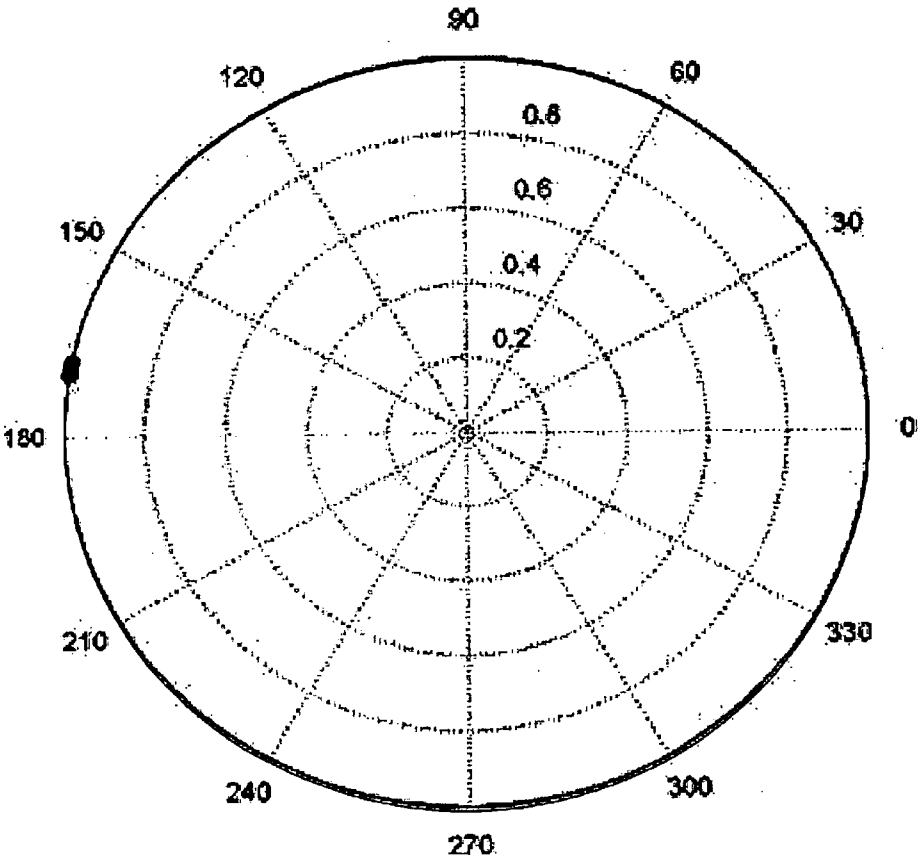

The electrical characteristics of the RFPIFA and short are shown in FIG. 10*a–f*. The measured RFPIFA and short are illustrated in FIGS. 8 and 9, respectively. The RFPIFA and short of FIGS. 8 and 9 were placed on a 2.5 mm dielectric spacer made from Rohacell Foam, as the PIFA above, and then measured. FIG. 10*a* shows the reactance of a 0.025 nH shorted inductor in a 100Ω system plotted from 2.4–2.5 GHz. FIG. 10*b* shows the reactance of a 100Ω transmission line that is 100 degrees long (lossless) at 2.4–2.5 GHz. FIG. 10*c* shows the reactance of the parallel combination of the open ended transmission line and the shorted inductor. Note the two elements together are resonant but there is no loss in the system. Similarly, FIG. 10*d* shows the reactance of a shorted inductor from 5–6 GHz. FIG. 10*e* shows the reactance of a 100Ω open ended transmission line that is 90 degrees long (lossless) at 2.45 GHz. FIG. 10*f* shows the reactance of the parallel combination of the open ended transmission line and the shorted inductor from 5–6 GHz.

As can be seen, the parallel combination of the shorted inductor and the open ended transmission line shown in FIG. 10*f* is nearly identical to the response of the short alone. The result suggests that the short in the 5–6 GHz element can be replaced by a RFPIFA without degrading the performance from 5–6 GHz thereby inviting the combination of a PIFA and a RFPIFA for use as a multi-band antenna. In general, when attempting to realize multi-band performance from PIFA elements with the resonances being an octave or more apart, the lower resonance will reactively load the higher frequency element and tend to limit the bandwidth of the upper resonance. The lower frequency element is electrically long at the upper resonance and the reactance of the lower frequency element will change quickly with frequency relative to the response of the upper resonance. However as can be seen by the electrical characteristics above, using a RFPIFA for the lower resonance eliminates this problem because the response of the RFPIFA is dominated by the response of the short when the reverse fed element is not resonant. The higher frequency element does not generally present a problem to the lower frequency element because the higher frequency element is electrically short in the lower band.

Figure 11:
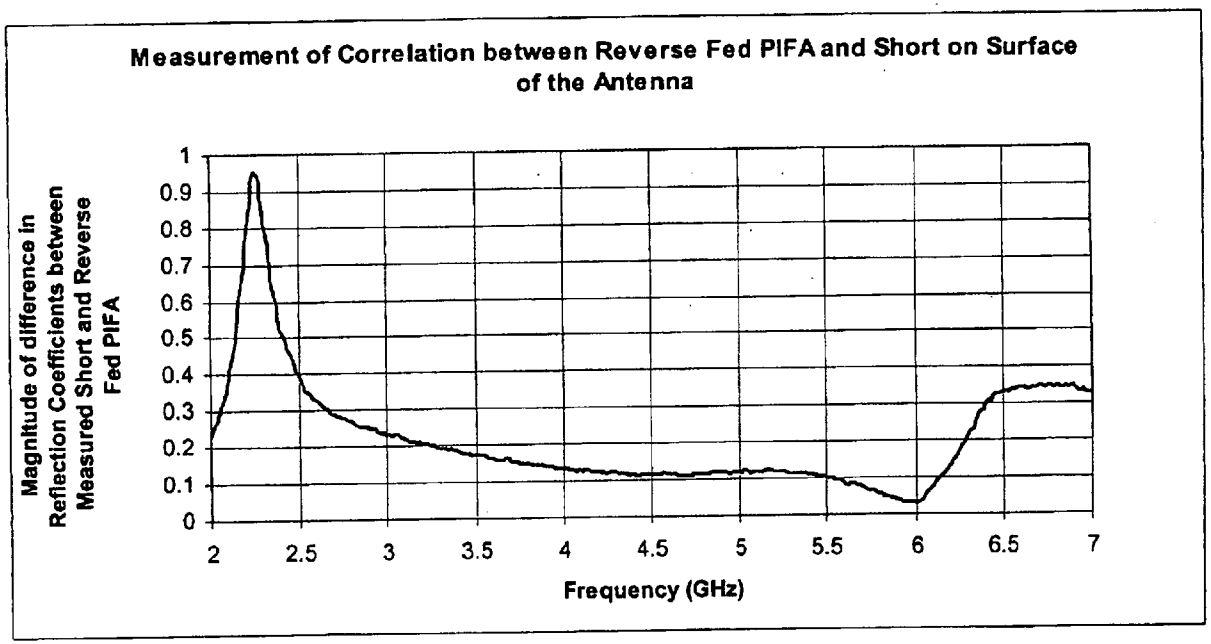
FIG. 11 shows the correlation between the RFPIFA and short of FIGS. 8 and 9.
Figure 12:
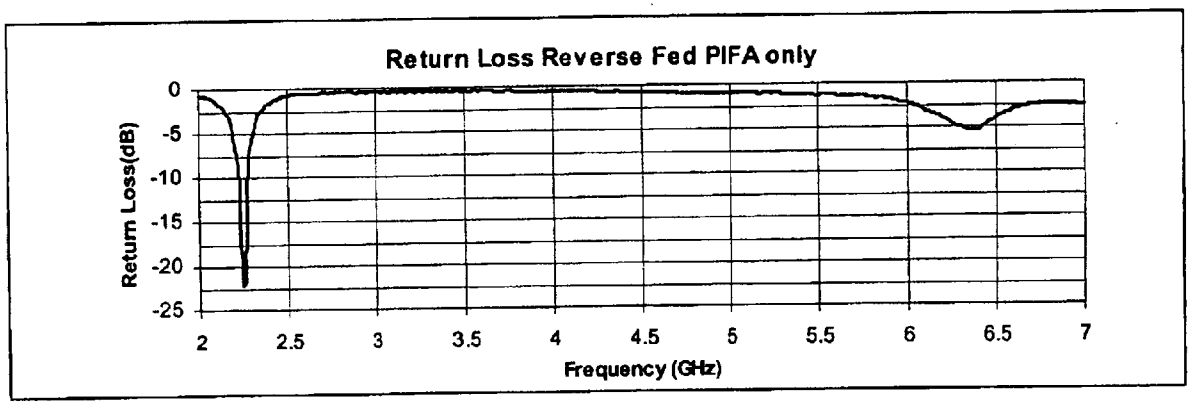
FIG. 12 illustrates the return loss of the RFPIFA of FIG. 8.

This is further shown by the measurements of FIGS. 11 and 12, which illustrate the correlation between a short on the surface of the antenna versus a reverse fed PIFA over frequency. One can see from these figures that there is a very good correlation between the RFPIFA and the short from 3.5 GHz to 6.25 GHz, which again suggests that the PIFA can be easily integrated with the RFPIFA that is resonant in the lower frequency range without significantly compromising the bandwidth of the higher frequency element.

Figure 13:
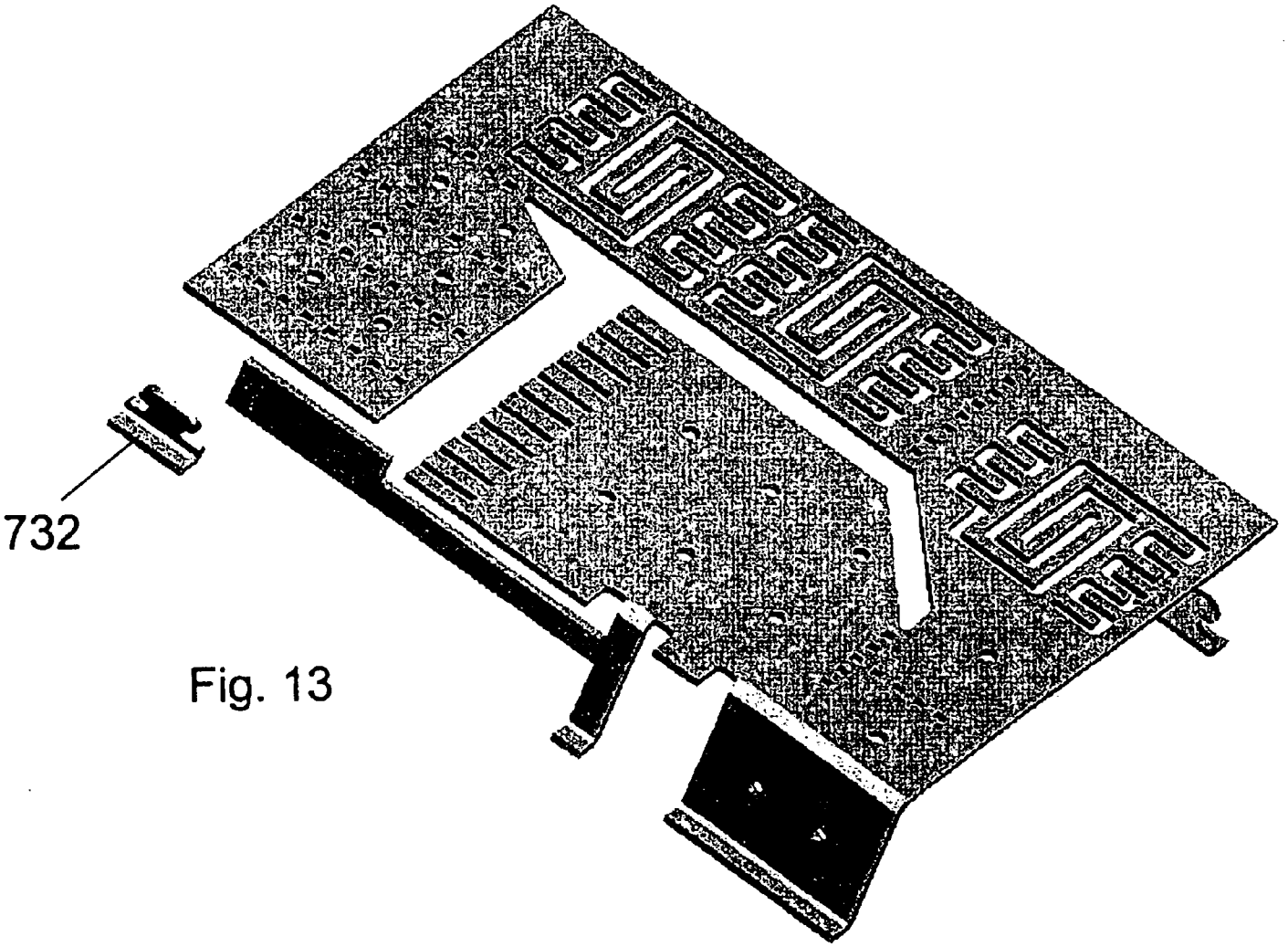
FIG. 13 shows a perspective view of an antenna of an embodiment.
Figure 14:
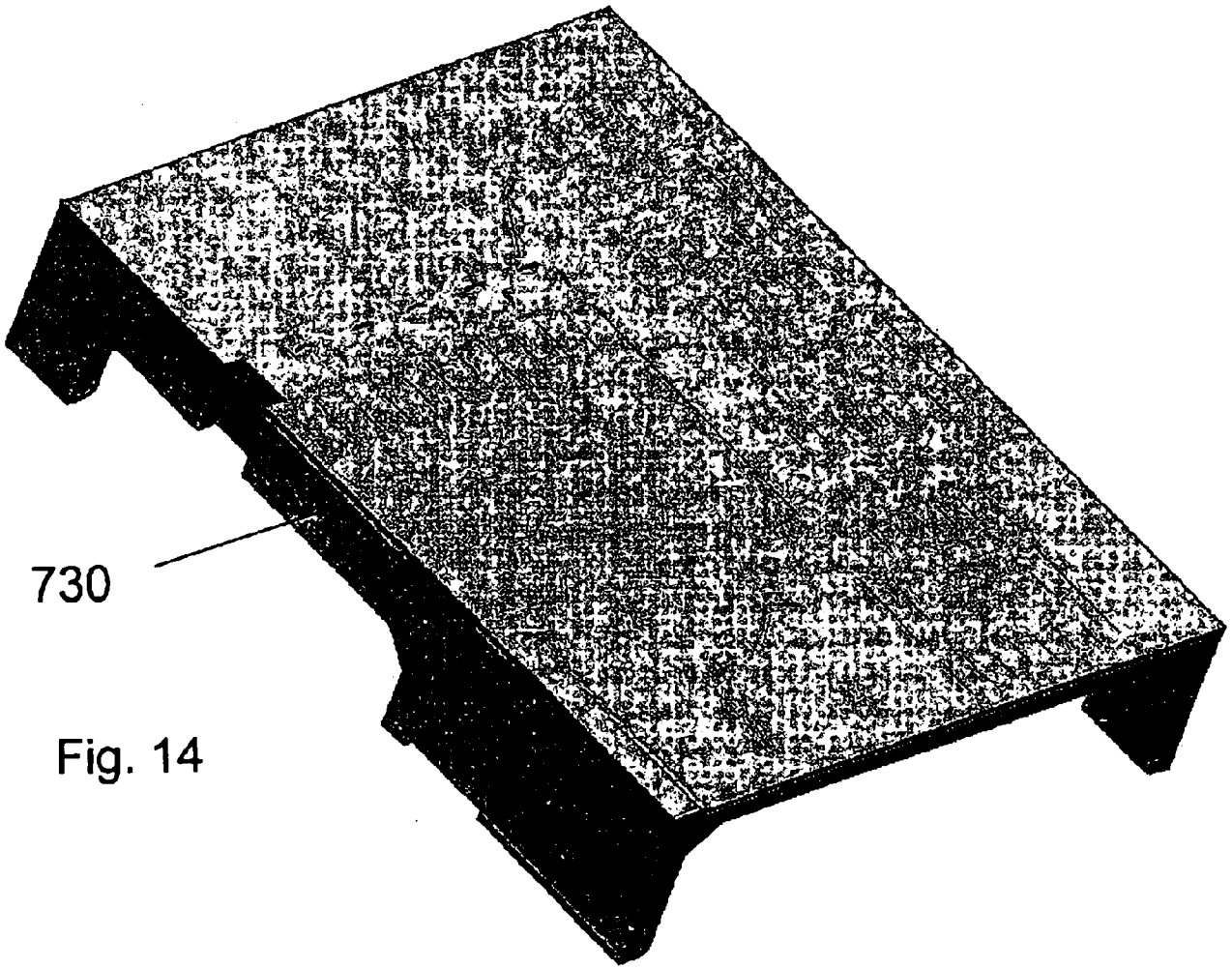
FIG. 14 shows a perspective view of an antenna of an embodiment.
Figure 15:
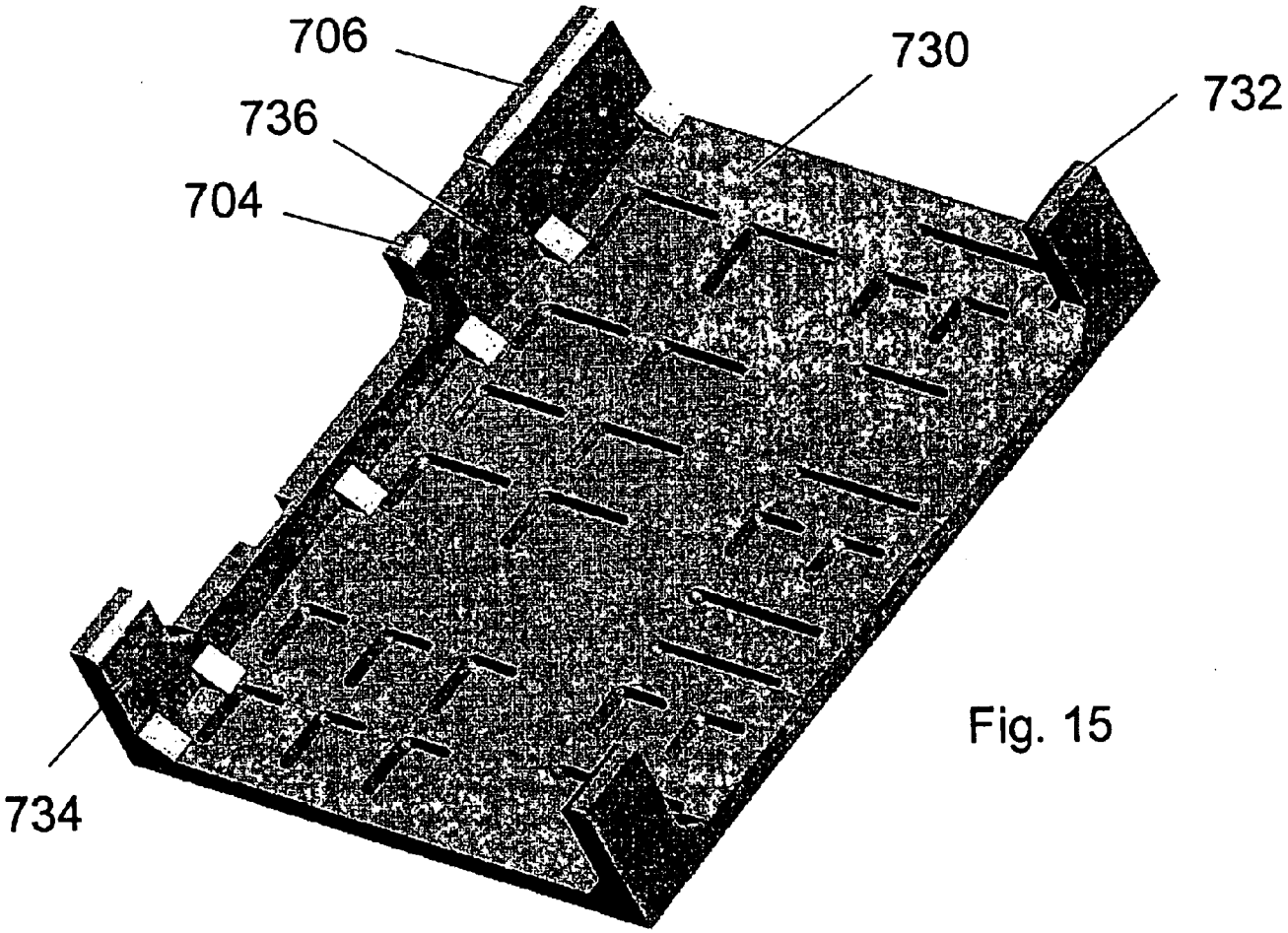
FIG. 15 shows a bottom view of an antenna of an embodiment.

FIGS. 13–15 illustrate three-dimensional views of FIG. 7 without a supporting structure or with an undercarriage. In general, the antenna 700 can be placed on any low dielectric material and mounted on a PCB. Low dielectric material is one or more layers having a total permittivity of the material is between 1 and about 1.7, preferably between about 1–1.4. An example of such a solid material is foam, for instance, as used in the test structures shown in FIGS. 8 and 9. Although the antenna 700 as illustrated in FIG. 13 (shown with conductive mounting feet 732) could be mounted directly on the PCB, the overall antenna structure would be relatively weak and easily damaged most frequently during mounting. The antenna 700 is thus formed with an undercarriage 730 to reinforce the structural integrity.

Details of the fabrication technique may be found in co-pending U.S. non-provisional patent application filed Oct. 2, 2002, entitled "Method of Manufacturing Antennas using Micro-Insert-Molding Techniques" in the names of Greg S. Mendolia and Yizhon Lin which is incorporated herein by reference in its entirety and commonly assigned to the assignee of the present application. Briefly however, the antenna 700 may be fabricated by stamping the antenna 700 design in metal. The metal is then placed in an injection mold, which is belly up with the metal disposed at the bottom of the mold. Liquid crystal polymer is then injected into the mold to form the plastic undercarriage 730 including legs 734. The injection of the polymer forces the metal to the surface of the mold and thereby makes the antenna structure highly repeatable. Standard surface mount techniques are used to assemble these antennas on the PCB (not shown); that is, introducing solder paste on mounting pads within the PCB, placing the antenna 700 on these pads with the conductive mounting feet 732 in contact with the solder, and melting the solder to form a permanent electrical connection between the antenna 700 and the PCB. The antenna 700 thus does not require any cables, connectors, tuning, or matching components and can be fabricated in a high volume production process without hand assembly.

After fabrication, the PIFA/RFPIFA is disposed about 3 mm from the ground plane. In general, the height of the structure, i.e. the distance of the PIFA/RFPIFA from the ground plane, can vary between about 2 mm to about 4 mm. This height is chosen according to design considerations that balance decreased separation between the PIFA/RFPIFA and the ground plane, which decreases the performance of the antenna, and increased separation, which increases the overall size of the antenna and may result in the antenna not meeting the height specifications of the electronics. The above separation of about 3 mm includes about 0.5 mm plastic undercarriage supporting the antenna and about 2.5 mm of air between the undercarriage and the ground plane. As above, the composite permittivity between the PIFA/RFPIFA and the ground plane is between 1.1 and 1.4.

The thickness of the undercarriage is chosen to balance the mechanical stability of the structure, which decreases with decreasing thickness, and the ability of the structure to straddle electronic components disposed underneath on the PCB, which decreases with increasing thickness (assuming that the overall thickness remains constant). In addition, the use of minimal plastic also helps to reduce the effect of the plastic on the resonance frequencies as well as variations caused by fluctuations in the dielectric of the plastic when the ratio of volume of plastic to volume of air is low (up to about 20–25%). Further, thinner plastic permits thicker metal for the antenna, feed, and short, which decreases overall resistive losses without overall increase in thickness. With these considerations, the thickness of the undercarriage is between about 0.4 mm to 1.0 mm, preferably about 0.3–0.5 mm.

The use of multiple legs promotes stability and robustness of the structure. In the antenna of the present embodiments, four legs are formed, which helps to stabilize the antennas when mounted and decrease the susceptibility of the antenna structure to inadvertently applied external force that may distort or destroy the antenna structure. The legs 734 have isolated islands of metal (the mounting feet 732) at the ends of all but one of the legs. As above, these small flat pieces of metal 732 are used as solderable surfaces to create mounting pads at the bottom of each leg 734. The last leg 736 has metal contacts that are directly connected between the main antenna 700 and the PCB (the ground plane and signal feed), and thus does not use the isolated mounting pads 734. The wider short 706 permits easier soldering to the ground plane, but does not significantly benefit the performance of the antenna 700. The antenna is mounted on an edge or corner location of the PCB for optimal performance: movement of the antenna to the sides of the board, away from the corner, results in a 2 to 3 dB loss in efficiency and movement to the center of large boards decreases the efficiency even further.

The antenna size after fabrication is relatively small, typically 10×14×2.4 mm and weighs a maximum of 0.18 g. The mounting area on the PCB required for a typical antenna is 140 $mm^2$, the total contact area on the PCB is 2.0 $mm^2$, and the maximum height of components under the antenna is 1.7 mm.

To determine the appropriate embodiment for a particular application, antenna samples are mounted to location on a PCB as required by the particular design along with all surrounding or underlying components. A standard surface mount technique with 5 mils thick solder paste on all mounting pads is used. The antenna performance is measured including resonant frequency and bandwidth. Components used during this measurement should be no greater than 1.0 mm in height from the PCB ground layer. The embodiment is determined based on measured return loss.

The reduction in size enabled by the antennas in the above embodiments makes these antennas particularly well suited for applications with densely populated PCBs. The electrical characteristics of the antenna, as shown above, are ideal for Bluetooth and 802.11b/g products particularly since they are often used in different environments ranging from ground planes the size of a thumbnail (for products such as wireless hands-free kits) to large ground planes (for applications such as printers or laptops). Also, due to the very low profile of the antenna, the antenna is well suited for demanding portable Bluetooth devices with severe restriction on total height.

Furthermore antennas can ultimately be fabricated as an integral part of the RF module; that is the antennas can be fabricated with a complete Bluetooth RF multi-chip module (MCM) system embedded inside the antenna. The antennas can be designed to accommodate both passive and active RF components within their form factor without any significant degradation of performance. In addition to being surface mountable directly on the board, components such as front-end modules or filters can be directly placed inside the antenna volume. Subsequently, the antenna can be seamlessly integrated into the radio frequency (RF) front end without adversely affecting performance.

In summary, the antenna is electrically small given that its largest dimension is $\lambda/10$. Size reduction is achieved without any dielectric loading, but instead by designing the antenna with built-in inductive and capacitive features to act as a slow wave structure. The antenna design does not use dielectric loading or traditional meander lines to reduce size, thus efficiency is maximized for minimum Q-factor. Such internal loading also allows the resonant frequency to be insensitive to proximity effects (of users, components such as integrated circuits or passive chips, or the loading effects of plastic housings), to temperature and humidity changes, and to changes in ground plane size and component layout. Further, these low profile antennas can be surface mounted directly onto a ground plane. This saves board space, permits components to be mounted beneath the antenna, and enables board area on the opposite side of the PCB to be used for additional components.

In addition, the antenna may be produced by repeatable high-volume manufacturing techniques using lightweight molded plastics and assembled using standard surface mount technology processes in which cables or connectors are not required.

Although antennas for multiple frequencies within the 2.4 and 5–6 GHz ranges are described above, there is no physical reason why the above structure cannot be scaled (and perhaps the FSS modified) for different frequencies and different applications. One example would be to use a RFPIFA structure of about 7 mm for reception and transmission in the 800 MHz range and incorporate a PIFA structure as the 1.9 or 2.4 GHz element.

While particular embodiments of the present invention have been shown and described, modifications may be made by one skilled in the art without altering the invention. It is therefore intended in the appended claims to cover such changes and modifications which follow in the true spirit and scope of the invention.

We claim:

1. A multiband antenna comprising:

a planar inverted F-antenna (PIFA) having a first resonant frequency; and a reverse-fed PIFA (RFPIFA) having a second resonant frequency lower than the first resonant frequency, the RFPIFA surrounding the PIFA on at least two sides of the PIFA.

2. The multiband antenna of claim 1, further comprising an out-of-plane matching stub to impedance match the multiband antenna with external elements.

3. The multiband antenna of claim 2, wherein the stub extends from a feed line and a length and width of the stub as well as a distance between the stub and a ground plane is chosen to optimize the impedance match.

4. The multiband antenna of claim 1, wherein the PIFA and RFPIFA comprise a conductive material separated from a ground plane by at least two layers having an effective permittivity of about 1 to about 1.7.

5. The multiband antenna of claim 4, wherein the two layers comprise a first layer of an undercarriage-and a second layer of air, the conductive material is disposed on the undercarriage, the undercarriage has legs that support the undercarriage.

6. The multiband antenna of claim 5, wherein an overall thickness of the multiband antenna is about 2 mm to 4 mm and a thickness of the first layer is about 0.3 to 1.0 mm.

7. The multiband antenna of claim 5, wherein the legs contact the ground plane such that the undercarriage is mounted on a printed circuit board (PCB) and the PIFA and RFPIFA are mounted over components mounted on the PCB.

8. The multiband antenna of claim 7, wherein the legs are plastic with metalized contacts positioned on the PCB for solder reflow connection.

9. The multiband antenna of claim 1, wherein the resonant frequencies of the PIFA and RFPIFA are mechanically adjustable.

10. The multiband antenna of claim 9, wherein mechanical adjustment of the PIFA comprises removal of a portion of the PIFA and mechanical adjustment of the RFPIFA comprises one of removal of a portion of the RFPIFA and addition of inductance at discrete locations by formation of a narrow inductive transmission line at the locations.

11. The multiband antenna of claim 1, wherein a majority of the PIFA is separated from the RFPIFA from about 0.3 mm to about 0.75 mm.

12. The multiband antenna of claim 1, further comprising an antenna element perpendicular to a ground plane that has a third resonant frequency higher than the first resonant frequency.

13. The multiband antenna of claim 1, wherein the multiband antenna is devoid of dielectric loading and meander lines.

14. The multiband antenna of claim 1, further comprising a PCB on which the multiband antenna is mounted and an RF feed through which signals are transmitted between the PCB and the PIFA and RFPIFA, wherein the multiband antenna is mounted at an edge of the printed circuit board.

15. The multiband antenna of claim 1, wherein a largest dimension of the RFPIFA is at most 1/10 of the second resonant frequency without dielectric loading.

16. The multiband antenna of claim 1, wherein the first resonant frequency is in a range of 5 to 6 GHz and the second resonant frequency is about 2.4 GHz.

17. The multiband antenna of claim 1, wherein the multiband antenna is relatively insensitive to proximity effects and to changes in ground plane size and component layout on a PCB on which the multiband antenna is mounted.

18. The multiband antenna of claim 1, wherein the RFPIFA comprises a meanderline.

19. The multiband antenna of claim 1, wherein the RFPIFA comprises a plurality of meanderlines each having the same shape.

20. The multiband antenna of claim 1, wherein the multiband antenna comprises a narrow inductive transmission line disposed between the PIFA and the RFPIFA.

21. The multiband antenna of claim 1, wherein the multiband antenna comprises a narrow inductive transmission line disposed one of between the PIFA and the RFPIFA and between multiple meanderlines of the RFPIFA.

22. The multiband antenna of claim 1, wherein a feed of the multiband antenna is disposed along approximately a middle of an edge of the PIFA and a short connected to a ground plane is disposed at approximately a corner of the PIFA and RFPIFA, the PIFA and RFPIFA being physically connected only at and proximate to the corner of the PIFA and RFPIFA.

23. A multiband antenna comprising:

a planar inverted F-antenna (PIFA) having a first resonant frequency; and a reverse-fed PIFA (RFPIFA) having a second resonant frequency lower than the first resonant frequency, the RFPIFA surrounding the PIFA substantially on three sides of the PIFA.

24. The multiband antenna of claim 23, further comprising an out-of-plane matching stub to impedance match the multiband antenna with external elements.

25. The multiband antenna of claim 24, wherein the stub extends from a feed line and a length and width of the stub as well as a distance of the stub from a ground plane is chosen to optimize the impedance match.

26. The multiband antenna of claim 23, wherein the PIFA and RFPIFA comprise a conductive material separated from a ground plane by two layers having an effective permittivity of about 1 to about 1.7.

27. The multiband antenna of claim 26, wherein the two layers comprise a first layer of an undercarriage and a second layer of air, the conductive material is disposed on the undercarriage, the undercarriage has legs that support the undercarriage.

28. The multiband antenna of claim 27, wherein an overall thickness of the multiband antenna is about 2 mm to 4 mm and a thickness of the first layer is about 0.3 to 1.0 mm.

29. The multiband antenna of claim 27, wherein the legs contact the ground plane such that the undercarriage is mounted on a printed circuit board (PCB) and the PIFA and RFPIFA are mounted over components mounted on the PCB.

30. The multiband antenna of claim 29, wherein the legs are plastic with metalized contacts positioned on the PCB for solder reflow connection.

31. The multiband antenna of claim 23, wherein resonant frequencies of the PIFA and RFPIFA are mechanically adjustable.

32. The multiband antenna of claim 31, wherein mechanical adjustment of the PIFA comprises removal of a portion of the PIFA and mechanical adjustment of the RFPIFA comprises one of removal of a portion of the RFPIFA and addition of inductance at discrete locations by formation of a narrow inductive transmission line at the locations.

33. The multiband antenna of claim 23, wherein a majority of the PIFA is separated from the RFPIFA from about 0.3 mm to about 0.75 mm.

34. The multiband antenna of claim 23, further comprising an antenna element perpendicular to a ground plane to communicate at a third frequency higher than the first frequency.

35. The multiband antenna of claim 23, further comprising a PCB on which the multiband antenna is mounted and an RF feed through which signals are transmitted between the PCB and the PIFA and RFPIFA, wherein the multiband antenna is mounted at an edge of the printed circuit board.

36. The multiband antenna of claim 23, wherein a largest dimension of the RFPIFA is at most 1/10 of the second resonant frequency without dielectric loading.

37. The multiband antenna of claim 23, wherein the first resonant frequency is in a range of 5 to 6 GHz and the second resonant frequency is about 2.4 GHz.

38. The multiband antenna of claim 23, wherein the multiband antenna is relatively insensitive to proximity effects and to changes in ground plane size and component layout on a PCB on which the multiband antenna is mounted.

39. The multiband antenna of claim 23, wherein the RFPIFA comprises a meanderline.

40. The multiband antenna of claim 23, wherein the RFPIFA comprises a plurality of meanderlines each having the same shape.

41. The multiband antenna of claim 23, wherein the multiband antenna comprises a narrow inductive transmission line disposed between the PIFA and the RFPIFA.

42. The multiband antenna of claim 23, wherein the multiband antenna comprises a narrow inductive transmission line disposed one of between the PIFA and the RFPIFA and between multiple meanderlines of the RFPIFA.

43. The multiband antenna of claim 23, wherein a feed of the multiband antenna is disposed along approximately a middle of an edge of the PIFA and a short connected to a ground plane is disposed at approximately a corner of the PIFA and RFPIFA, the PIFA and RFPIFA being physically connected only at and proximate to the corner of the PIFA and RFPIFA.

44. A multiband antenna comprising:

a planar inverted F-antenna (PIFA) having a first resonant frequency; and a reverse-fed PIFA (RFPIFA) having a second resonant frequency lower than the first resonant frequency, the RFPIFA surrounding the PIFA substantially on three sides of the PIFA, the PIFA and the RFPIFA each having a first set of adjustment portions that are removable and the RFPIFA having a second set of adjustment portions that form narrow inductive transmission lines.

45. The multiband antenna of claim 44, further comprising an out-of-plane matching stub to impedance match the multiband antenna with external elements.

46. The multiband antenna of claim 45, wherein the stub extends from a feed line and a length and width of the stub as well as a distance between the stub and a ground plane is chosen to optimize the impedance match.

47. The multiband antenna of claim 44, wherein the PIFA and RFPIFA comprise a conductive material separated from a ground plane by two layers having an effective permittivity of about 1 to about 1.7.

48. The multiband antenna of claim 47, wherein the two layers comprise a first layer of an undercarriage and a second layer of air, the conductive material is disposed on the undercarriage, the undercarriage has legs that support the undercarriage.

49. The multiband antenna of claim 48, wherein an overall thickness of the multiband antenna is about 2 mm to 4 mm and a thickness of the first layer is about 0.3 to 1.0 mm.

50. The multiband antenna of claim 48, wherein the legs contact the ground plane such that the undercarriage is mounted on a printed circuit board (PCB) and the PIFA and RFPIFA are mounted over components mounted on the PCB.

51. The multiband antenna of claim 50, wherein the legs are plastic with metalized contacts positioned on the PCB for solder reflow connection.

52. The multiband antenna of claim 44, wherein a majority of the PIFA is separated from the RFPIFA from about 0.3 mm to about 0.75 mm.

53. The multiband antenna of claim 44, further comprising an antenna element perpendicular to a ground plane that has a third resonant frequency higher than the first resonant frequency.

54. The multiband antenna of claim 44, further comprising a PCB on which the multiband antenna is mounted and an RF feed through which signals are transmitted between the PCB and the PIFA and RFPIFA, wherein the multiband antenna is mounted at an edge of the printed circuit board.

55. The multiband antenna of claim 44, wherein a largest dimension of the RFPIFA is at most 1/10 of the second resonant frequency without dielectric loading.

56. The multiband antenna of claim 44, wherein the first resonant frequency is in a range of 5 to 6 GHz and the second resonant frequency is about 2.4 GHz.

57. The multiband antenna of claim 44, wherein the multiband antenna is relatively insensitive to proximity effects and to changes in ground plane size and component layout on a PCB on which the multiband antenna is mounted.

58. The multiband antenna of claim 44, wherein the RFPIFA comprises a meanderline.

59. The multiband antenna of claim 44, wherein the RFPIFA comprises a plurality of meanderlines each having the same shape.

60. The multiband antenna of claim 44, wherein the multiband antenna comprises a narrow inductive transmission line disposed between the PIFA and the RFPIFA.

61. The multiband antenna of claim 44, wherein the multiband antenna comprises a narrow inductive transmission line disposed one of between the PIFA and the RFPIFA and between multiple meanderlines of the RFPIFA.

62. The multiband antenna of claim 44, wherein a feed of the multiband antenna is disposed along approximately a middle of an edge of the PIFA and a short connected to a ground plane is disposed at approximately a corner of the PIFA and RFPIFA, the PIFA and RFPIFA being physically connected only at and proximate to the corner of the PIFA and RFPIFA.

63. A multiband antenna comprising:

a planar inverted F-antenna (PIFA) having a first resonant frequency; and a reverse-fed PIFA (RFPIFA) having a second resonant frequency lower than the first resonant frequency, the PIFA and RFPIFA integrally formed from a single piece of conductive material and attached at one end such that dimensions of the multiband antenna are defined substantially by the RFPIFA.

64. A method for multiband reception of an antenna comprising:

communicating in a first resonant frequency via a planar inverted F-antenna (PIFA);

communicating in a second resonant frequency lower than the first resonant frequency via a reverse-fed PIFA (RFPIFA); and limiting an area of the PIFA and RFPIFA such that dimensions of the antenna are defined substantially by the RFPIFA.

65. A method for multiband reception of an antenna comprising:

communicating in a first resonant frequency via a planar inverted F-antenna (PIFA);

communicating in a second resonant frequency lower than the first resonant frequency via a reverse-fed PIFA (RFPIFA); and adjusting one of the first and second frequencies by one of removing a portion of the one of PIFA and the RFPIFA and changing inductance at a discrete location that include one of in the RFPIFA and between the PIFA and RFPIFA.

* * * * *